US008109516B2

(12) United States Patent
Cacas

(10) Patent No.: US 8,109,516 B2
(45) Date of Patent: Feb. 7, 2012

(54) METHOD OF AND APPARATUS FOR GAMING

(76) Inventor: Clay T. Cacas, Terrell, TX (US)

( * ) Notice: Subject to any disclaimer, the term of this patent is extended or adjusted under 35 U.S.C. 154(b) by 249 days.

(21) Appl. No.: 11/530,066

(22) Filed: Sep. 8, 2006

(65) Prior Publication Data

US 2007/0024003 A1 Feb. 1, 2007

Related U.S. Application Data

(63) Continuation-in-part of application No. 11/292,663, filed on Dec. 2, 2005, now Pat. No. 7,413,193, and a continuation-in-part of application No. 11/055,765, filed on Feb. 11, 2005, now abandoned, which is a continuation-in-part of application No. 11/039,181, filed on Jan. 20, 2005, now abandoned, which is a continuation-in-part of application No. 10/860,398, filed on Jun. 3, 2004, now abandoned, which is a continuation of application No. 10/403,275, filed on Apr. 1, 2003, now abandoned.

(51) Int. Cl.
*A63F 9/04* (2006.01)

(52) U.S. Cl. ..... 273/274; 273/146

(58) Field of Classification Search ..... 273/146, 273/274

See application file for complete search history.

(56) References Cited

U.S. PATENT DOCUMENTS

| | | | | |
|---|---|---|---|---|
| 4,060,246 A | | 11/1977 | Ward | 273/135 |
| 4,506,890 A | | 3/1985 | Murray | 463/22 |
| 4,887,819 A | | 12/1989 | Walker | 273/256 |
| 4,902,019 A | | 2/1990 | Berman | 273/256 |
| 5,133,559 A | | 7/1992 | Page | 273/274 |
| 5,413,351 A | | 5/1995 | Franklin | 273/274 |
| 5,512,850 A | | 4/1996 | Mo | 327/108 |
| 5,513,850 A | | 5/1996 | Vancura | 273/274 |
| 5,662,330 A | | 9/1997 | Spears | 273/274 |
| 5,728,002 A | | 3/1998 | Hobert | 463/17 |
| 5,788,239 A | * | 8/1998 | Kong | 273/274 |
| 5,788,240 A | | 8/1998 | Feinberg | 273/274 |
| 5,791,651 A | | 8/1998 | Bryant | 273/274 |
| 5,829,749 A | | 11/1998 | Hobert | 273/274 |
| 5,964,463 A | | 10/1999 | Moore, Jr. | 273/274 |
| 6,074,720 A | | 6/2000 | Van Stratum | 428/41.4 |
| 6,102,403 A | | 8/2000 | Kaufman | 273/292 |
| 6,176,489 B1 | | 1/2001 | Astancha | 273/274 |
| 6,257,579 B1 | | 7/2001 | Horan | 273/274 |
| 6,257,580 B1 | | 7/2001 | Brown | 273/274 |
| 6,302,395 B1 | | 10/2001 | Astancha | 273/274 |
| 6,328,305 B1 | | 12/2001 | Yuan | 273/274 |
| 6,378,869 B1 | | 4/2002 | Hedge, Jr. et al. | 273/274 |
| 6,601,848 B1 | | 8/2003 | Timmons | 273/146 |
| 6,648,756 B2 | | 11/2003 | Moody | 463/18 |
| 6,655,689 B1 | | 12/2003 | Stasi | 273/274 |
| 6,805,352 B2 | | 10/2004 | Hunter | 273/274 |

(Continued)

OTHER PUBLICATIONS

"Craps", European and Asian Games, Syd Helprin, Gambling Times Incorporated, pp. 99-118, 1986.

(Continued)

*Primary Examiner* — Benjamin Layno

(57) ABSTRACT

An otherwise conventional craps table is provided with one or more unique wagering opportunities each comprising odds which are more favorable to the craps player as compare with the odds associated with traditional craps wagers. Utilization of the wager opportunities comprising the present invention attracts more players to the craps table and thereby ultimately benefits the craps table operator.

6 Claims, 19 Drawing Sheets

U.S. PATENT DOCUMENTS

| | | | | |
|---|---|---|---|---|
| 6,854,732 | B2 | 2/2005 | Moody | 273/146 |
| 6,913,262 | B2 | 7/2005 | Berman | 273/292 |
| D522,069 | S | 5/2006 | Stasi | D21/354 |
| 7,100,919 | B2 | 9/2006 | Stasí | 273/274 |
| 7,229,352 | B2 | 6/2007 | Bonito | 463/22 |
| 7,255,350 | B2 | 8/2007 | Timmons | 273/274 |
| 7,309,066 | B2 | 12/2007 | Donaldson | 273/292 |
| 7,331,860 | B2 | 2/2008 | Herrmann | 463/16 |
| 7,335,103 | B2 | 2/2008 | Seelig | 463/22 |
| 7,341,519 | B2 | 3/2008 | McMain | 463/25 |
| D570,419 | S | 6/2008 | Stasi | D21/369 |
| 2001/0042960 | A1 | 11/2001 | Lewis et al. | 273/274 |
| 2002/0043766 | A1 | 4/2002 | Berman | 273/292 |
| 2003/0107172 | A1 | 6/2003 | Moody | 273/146 |
| 2005/0212213 | A1 | 9/2005 | Inglese | 273/292 |

OTHER PUBLICATIONS

Dice and Their Many Games, Scarne's Encyclopedia of Games, John Scarne, pp. 454-464, 1973.

Book entitled "Scarne on Dice", by John Scarne, copyrighted 1945 & 1946, p. 113, Jan. 1945.

* cited by examiner

METHOD OF AND APPARATUS FOR GAMING

CROSS-REFERENCE TO RELATED APPLICATIONS

This application is continuation-in-part application of application Ser. No. 11/292,663 filed Dec. 2, 2005 now U.S. Pat. No. 7,413,193, the entire contents of which are incorporated herein by reference; and of application Ser. No. 11/055,765 filed Feb. 11, 2005 now abandoned, the entire contents of which are incorporated herein by reference; which is a continuation-in-part application of application Ser. No. 11/039,181 filed Jan. 20, 2005 now abandoned, currently pending, the entire contents of which are incorporated herein by reference; which is a continuation-in-part application of application Ser. No. 10/860,398 filed Jun. 3, 2004, abandoned, the entire contents of which are incorporated herein by reference; which is a continuation of application Ser. No. 10/403,275 filed Apr. 1, 2003, abandoned, the entire contents of which are incorporated herein by reference.

TECHNICAL FIELD

This invention relates generally to games of chance and more particularly to improvements in the gaming activity known as craps.

BACKGROUND AND SUMMARY OF THE INVENTION

As is well known to those skilled in the art, the gaming activity known as craps is a table game, that is, craps is played on a gaming table as opposed to a gaming machine. Gaming machines which emulate the craps table game are also known, and the present invention is equally applicable thereto.

Craps differs from other table games in that the bets or wagers which are available to the player are clearly delineated on the craps table. Stated conversely, the only bets that can be made in the game of craps are identified with and stated on segregated areas of the craps table. In order to make a bet, a craps player places a selected number of chips on the segment of the craps table corresponding to the selected bet, whereupon the bet is made.

Referring to FIG. 1 of the drawings, there is shown a conventional craps table 10. As stated above, all of the bets or wagers that are possible in the game of craps are clearly stated on the craps table 10 and are associated with a particular designated segment thereof. Thus, if a player wishes to place a "COME" bet, the player places one or more chips in one of the segments 12 of the craps table 10 at the designated time during play of the craps game.

Having particular reference to the segments 14 of the craps table 10, two of the bets which are disfavored by craps players are known as "Big 6" and "Big 8". The "Big 6" and "Big 8" bets are generally referred to in the industry as "sucker bets" because the odds of winning these bets favor the house to a much greater extent as compared to other bets or wagers which are available on the craps table 10. Also, the payout resulting from a winning "BIG 6" or "BIG 8" is considered inadequate by most craps players.

Although a wager favoring the house might at first seem advantageous to the operator of the craps table 10, in the long run this is not the case. Thus, although a novice might occasionally make a "Big 6" or "Big 8" wager, the player will not do so again upon learning that the odds pertaining to such a bet so strongly favor the house. Therefore, because the areas of the craps table 10 associated with the "Big 6" and "Big 8" wagers go virtually unused, the areas 14 of the crap table 10 represent wasted space which does not earn revenue for the operator of the craps table 10.

The present invention comprises an improvement in the game of craps which overcomes the foregoing and other difficulties which have long since characterized the prior art. In accordance with the invention, one or more segments of the craps table heretofore associated with the bets known as "Big 6" and "Big 8" are replaced with different betting or waging opportunities which are much more favorable to the player. Alternatively, some craps tables may already have the "Big 6" and "Big 8" betting options removed, in which case the present invention comprises betting opportunities in addition to those already presented on the craps table.

The assignment of portions of the craps table to betting opportunities more favorable to the player is ultimately advantageous to the operator of the craps table in that craps tables incorporating the present invention will attract additional players as compared with conventional craps tables not incorporating the present invention. Thus, because all bets or wagers available in the game of craps ultimately favor the house to a greater or lesser degree, operators of craps tables incorporating the present invention will ultimately realize increased revenues as opposed to operators of conventional craps tables.

Having particular reference to the segment 16 of the craps table 10, another bet with odds favoring the house, but popular among craps players is betting the "Hardways." A "Hardways" player wagers that the Shooter will roll either a double two, a double three, a double four, or a double five, resulting in a hard four, six, eight, or ten respectively, before a seven is rolled. If the shooter rolls the selected "hard" number in doubles, the payoff is high for the player, specifically a ten-to-one payout. However, if the selected number is rolled in a combination other than doubles, the player loses the bet.

In accordance with another embodiment of the present invention there is provided a different wagering opportunity for a player to wager that a "hard" number will be thrown, the difference being that the bet is not lost if the selected number is thrown in a combination other than doubles. This provides a better betting alternative to the player because the only throw that defeats the bet is a seven, and may be referred to as a "Softways" bet.

As well become more apparent hereinafter, the present invention comprises other and further modifications of and additions to conventional craps table layouts all of which favor the craps player and therefore ultimately benefit the craps table operator.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
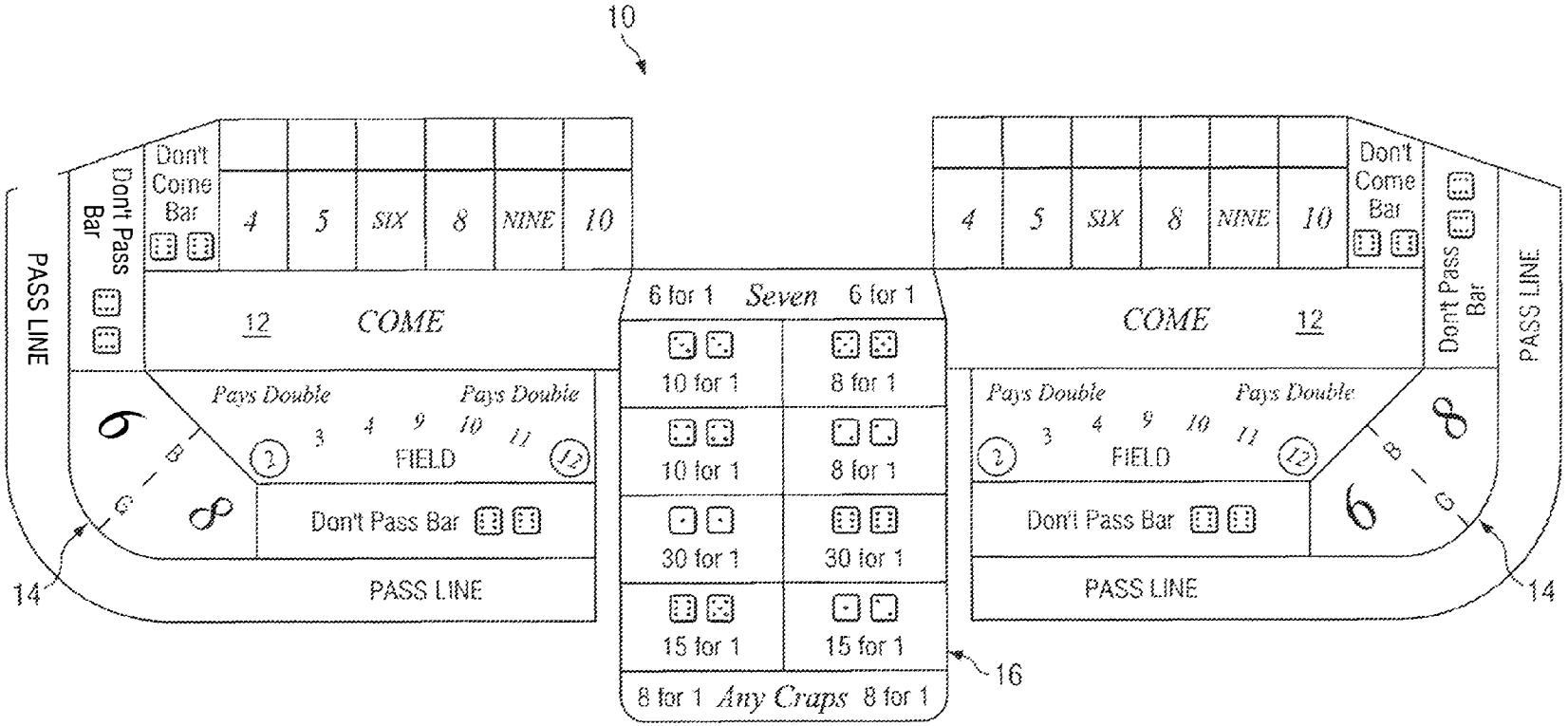
FIG. 1 (PRIOR ART)
FIG. 1 is an illustration of a prior art craps table.
Figure 2:
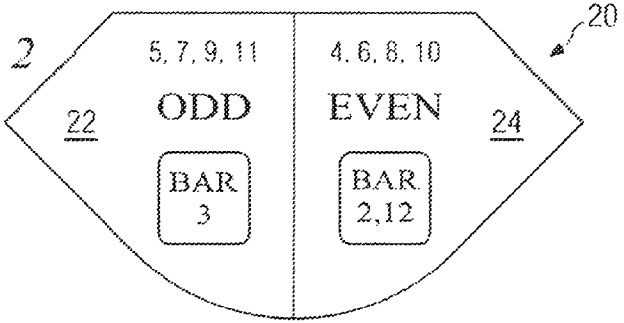
FIG. 2 is an illustration of novel craps wagering opportunities comprising the present invention.

Referring now to the Drawings, and particularly to FIG. 2, there is shown a craps table segment 20 incorporating the present invention. As will be appreciated by those skilled in the art, the craps table segment 20 is intended as a replacement for the segments 14 of the craps table 10 shown in FIG. 1 whereby the wagering opportunities afforded by means of the present invention replace the Big 6 and Big 8 wagers of a conventional craps table. Alternatively, some craps tables may already have the "Big 6" and "Big 8" betting options removed, in which case the present invention comprises betting opportunities in addition to those already presented on the craps table.

The segment 20 includes an odd portion 22 and an even portion 24. By placing one or more chips on the odd portion 22 the player wagers that a five, a seven, a nine, or an eleven will be thrown on the next roll of the dice during the play of the craps game. If an odd number is thrown the player receives a payout equal to one time the original bet while retaining the original bet. If an even number is thrown the player loses the original bet. If a three is thrown the player does not receive a payout nor does the player lose the original bet. The bet remains for the next throw of the dice unless the player opts to take down the bet.

By placing one or more chips on the even portion 24 the player wagers that a four, a six, an eight, or a ten will be thrown on the next roll of the dice during the play of the craps game. If an even number is thrown the player receives a payout equal to one time the original bet while retaining the original bet. If an odd number is thrown the player loses the original bet. If a two or a twelve is thrown the player does not receive a payout nor does the player lose the original bet. The bet remains for the next throw of the dice unless the player opts to take the bet down. As will therefore be understood by those skilled in the art the bets provided to the craps player by this embodiment of the present invention resemble, in some respects, the conventional "field" bet.

Figure 3:
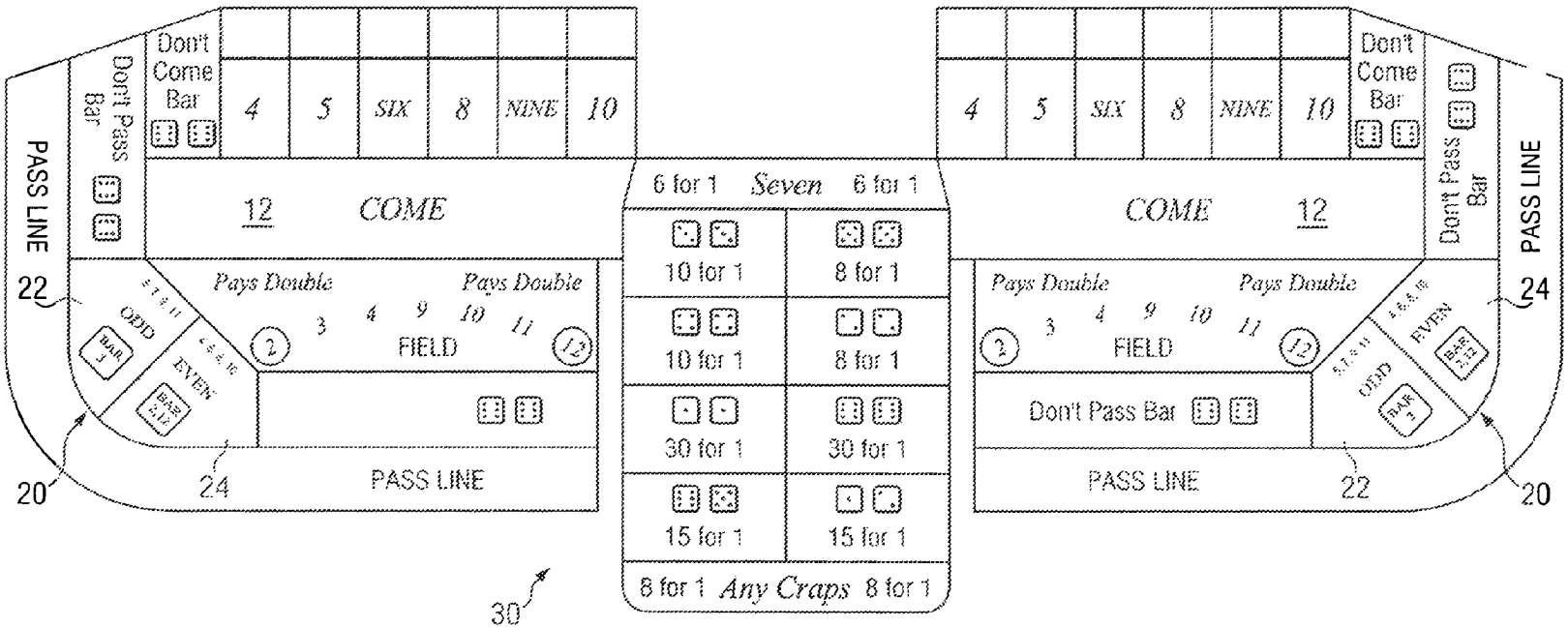
FIG. 3 is an illustration of a craps table incorporating the wagering opportunity shown in FIG. 2.

FIG. 3 illustrates a craps table 30 incorporating the embodiment of the present invention illustrated in FIG. 2. The craps table 30 is identical to the craps table 10 of FIG. 1 except that the craps table segment 20 shown in FIG. 2 replaces both of the craps table segments 14 shown in FIG. 1. The use of the craps table 30 of FIG. 3 is highly advantageous both to the player and to the table operator as compared with the use of the craps table 10 of FIG. 1. With respect to the craps player the use of the segment 20 and the wagering opportunities afforded by means of the present invention provides better odds and more payout opportunities. With respect to the craps table operator the use of the segment 20 and the wagering opportunities of the present invention attracts more players to the craps table which ultimately results in a larger return to the table operator.

Figure 4:
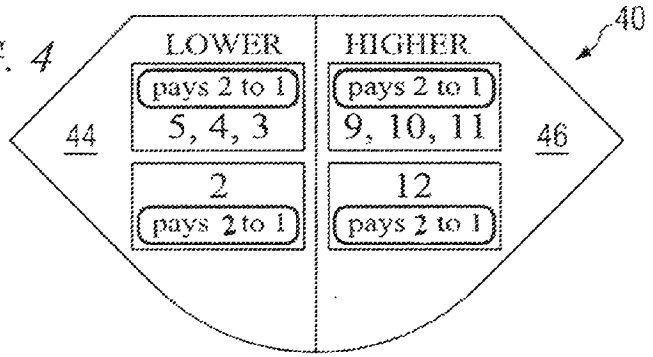
FIG. 4 is an illustration of another novel craps wagering opportunities comprising the present invention.

FIG. 4 illustrates a craps table segment 40 intended as a replacement for the segments 14 of the craps table 10 shown in FIG. 1. The segment 40 includes a low portion 44 and a high portion 46. By placing one or more chips on the low portion 44 the player wagers that a two, a three, a four, or a five will be thrown on the next roll of the dice during the play of the craps game. If a two is thrown on the next roll the player receives a payout equal to two times the original bet while retaining the original bet. If a three, a four, or a five is thrown on the next roll, the player receives a payout equal to two times the original bet while retaining the original bet.

If a player places one or more chips on the high portion 46 of the segment 40 the player wagers that a nine, a ten, an eleven, or a twelve will be thrown on the next roll of the dice during the play of the craps game. If a twelve is thrown on the next roll during play of the craps game the player receives a payout equal to two times the original wager while retaining the original wager. If a nine, a ten, or an eleven is thrown on the next roll during play of the craps game the player receives a payout equal to two times the original wager while retaining the original wager. As will therefore be understood by those skilled in the art the bets provided to the craps player by this embodiment of the present invention resemble, in some respects, the conventional "field" bet.

Figure 5:
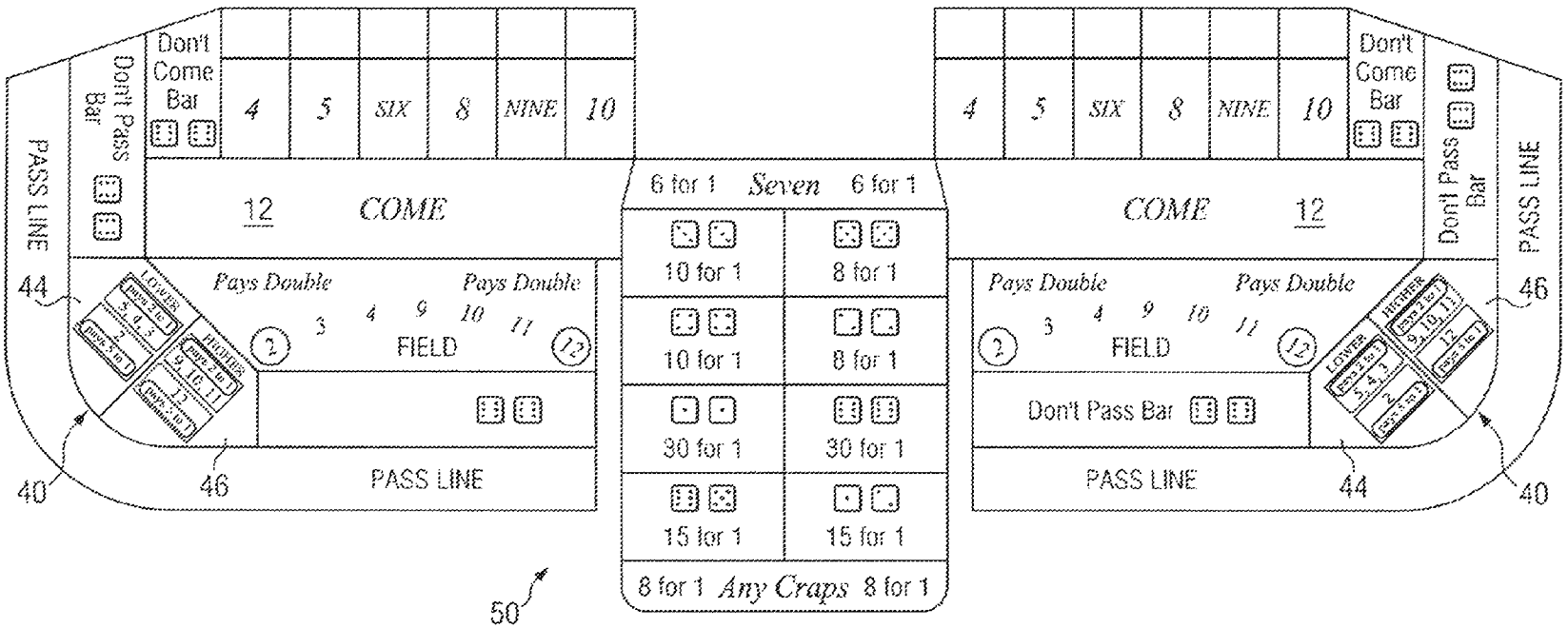
FIG. 5 is an illustration of a craps table incorporating the wagering opportunity shown in FIG. 4.

FIG. 5 illustrates a craps table 50 incorporating the embodiment of the present invention illustrated in FIG. 4. The craps table 50 is identical to the craps table 10 of FIG. 1 except that the craps table segment 40 shown in FIG. 4 replaces both of the craps table segments 14 shown in FIG. 1. The use of the craps table 50 of FIG. 5 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 6:
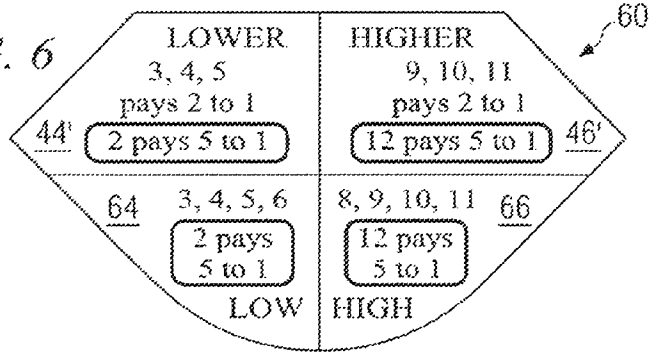
FIG. 6 is an illustration of yet another novel craps wagering opportunity comprising the present invention.

FIG. 6 illustrates a craps table segment 60 similar to the craps table segment 40 illustrated in FIG. 4. Many of the portions of the craps table segment 60 are substantially identical in construction and function to the segments of the craps table segment 40 illustrated in FIG. 4 described hereinabove in conjunction therewith. Such identical component parts are designated in FIG. 6 with the same reference numerals utilized above in the description of the craps table segment 60, but are differentiated therefrom by means of a prime (') designation.

The craps table segment 60 differs from the craps table segment 40 of FIG. 4 in that the craps table segment 60 offers two additional betting options. Below the low portion 44' is an alternate low portion 64 allowing the player to wager that a two, a three, a four, a five, or a six will be thrown on the next roll of the dice. If a two is thrown the player receives a payout equal to five times the original bet while retaining the original bet. If a three, a four, a five, or a six is thrown on the next roll of the dice the player receives a payout equal to the original bet while retaining the original bet. Below the high portion 46' is an alternate high portion 66 allowing the player to wager that an eight, a nine, a ten, an eleven, or a twelve will be thrown on the next roll of the dice. If a twelve is thrown the player receives a payout equal to five times the original bet while retaining the original bet. If an eight, a nine, a ten, or an eleven is thrown on the next roll of the dice the player receives a payout equal to the original bet while retaining the original bet. As will therefore be understood by those skilled in the art the bets provided to the craps player by this embodiment of the present invention resemble, in some respects, the conventional "field" bet.

Figure 7:
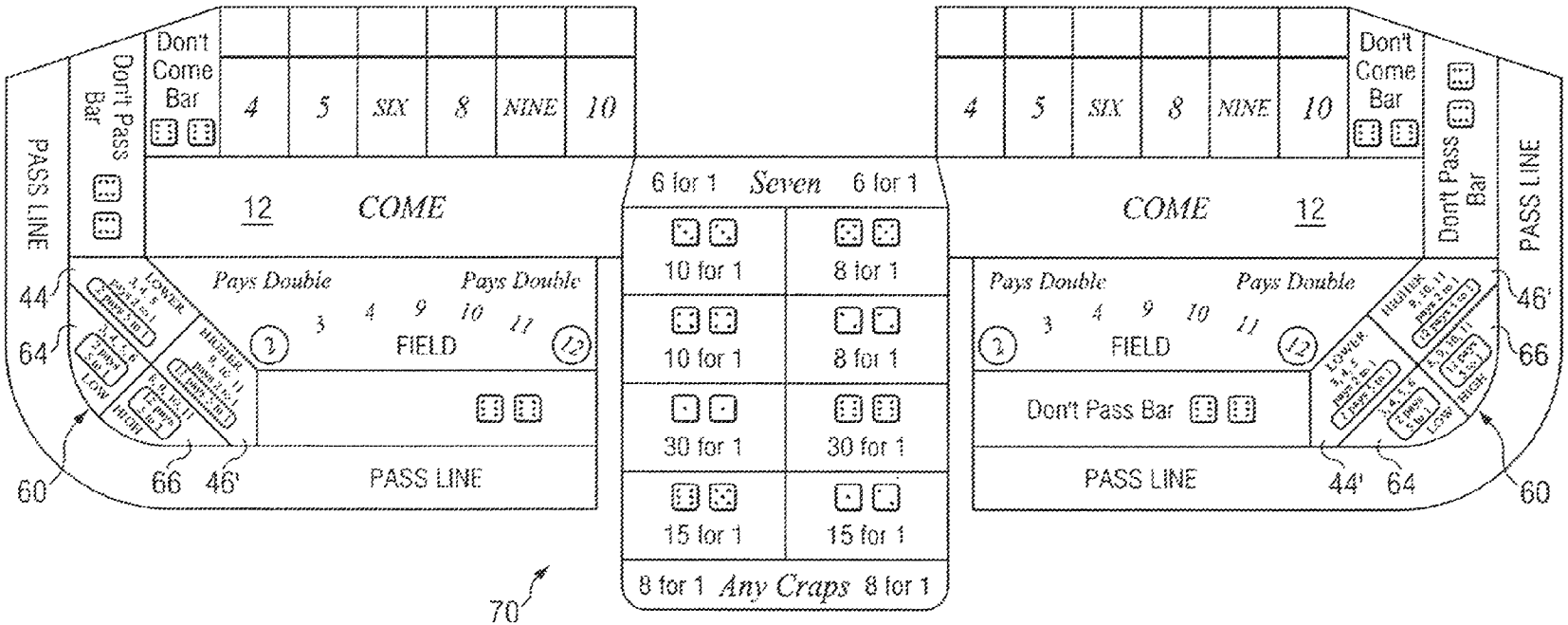
FIG. 7 is an illustration of a craps table incorporating the wagering opportunity shown in FIG. 6.

FIG. 7 illustrates a craps table 70 incorporating the embodiment of the present invention illustrated in FIG. 6. The craps table 70 is identical to the craps table 10 of FIG. 1 except that the craps table segment 60 shown in FIG. 6 replaces both of the craps table segments 14 shown in FIG. 1. The use of the craps table 70 of FIG. 7 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 8:
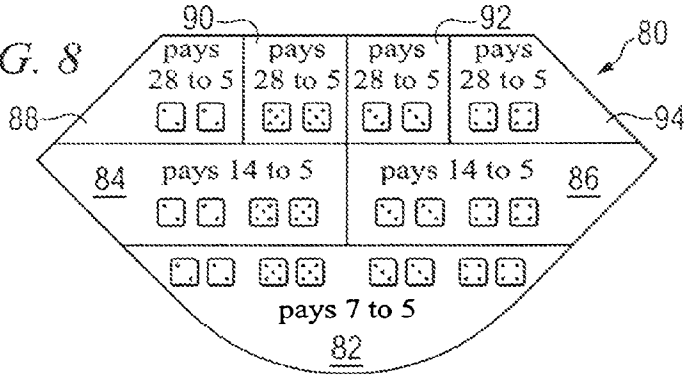
FIG. 8 is an illustration of yet another novel craps wagering opportunity comprising the present invention.

FIG. 8 illustrates a craps table segment 80 intended as a replacement for the segments 14 of the craps table 10 shown in FIG. 1 whereby the wagering opportunities afforded by means of the present invention replace the Big 6 and Big 8 wagers of a conventional craps table. The segment 80 includes six "Softways" segments wherein a player can wager that a hard number will be thrown before a seven is thrown. A "Hard" number is thrown by rolling doubles. Distinct from the "Hardways" segment 16 of the craps table 10 shown in FIG. 1 the "Softways" segment allows the player to wager that a "hard" number will be thrown but the wager is not lost if the selected number is thrown in a combination other than doubles.

Specifically, the segment 80 includes a multi-number portion 82 that allows the player to wager that a double two, double three, double four, or double five, resulting in a hard four, a hard six, a hard eight, or a hard ten, will be thrown in doubles on the next roll of the dice. If doubles are thrown the player receives a 7 to 5 payout while retaining the amount of the original bet. If a four, six, eight, or ten is thrown in a combination other than doubles, or any other number besides a seven is thrown, the player neither wins nor loses their bet. The player may keep the bet posted for the next roll of dice or opt to take the bet down. Only the roll of a seven results in the player losing the bet.

In addition to the multi-number portion 82 the segment 80 includes a four-ten portion 84 and a six-eight portion 86. The four-ten portion 84 is similar to the multi-number portion 82 with the only difference being that the bet is narrowed to only a four ora ten being thrown. Similarly, the six-eight portion 86 wagers only for a six or an eight to be thrown in doubles. For both the four-ten portion 84 and the six-eight portion 86 the player wins if the selected numbers are thrown in doubles. The payout is 14 to 5 while retaining the amount of the original bet.

Finally, the segment 80 includes individual portions 88, 90, 92, and 94 for each of the hard numbers four, ten, six, and eight 94, respectively, allowing the player to wager only one number being thrown in doubles. Only the roll of a seven causes a player to lose a bet on any portion of the segment 80. As will therefore be understood by those skilled in the art the bets provided to the craps player by this embodiment of the present invention resemble, in some respects, the conventional "place" bet.

Figure 9:
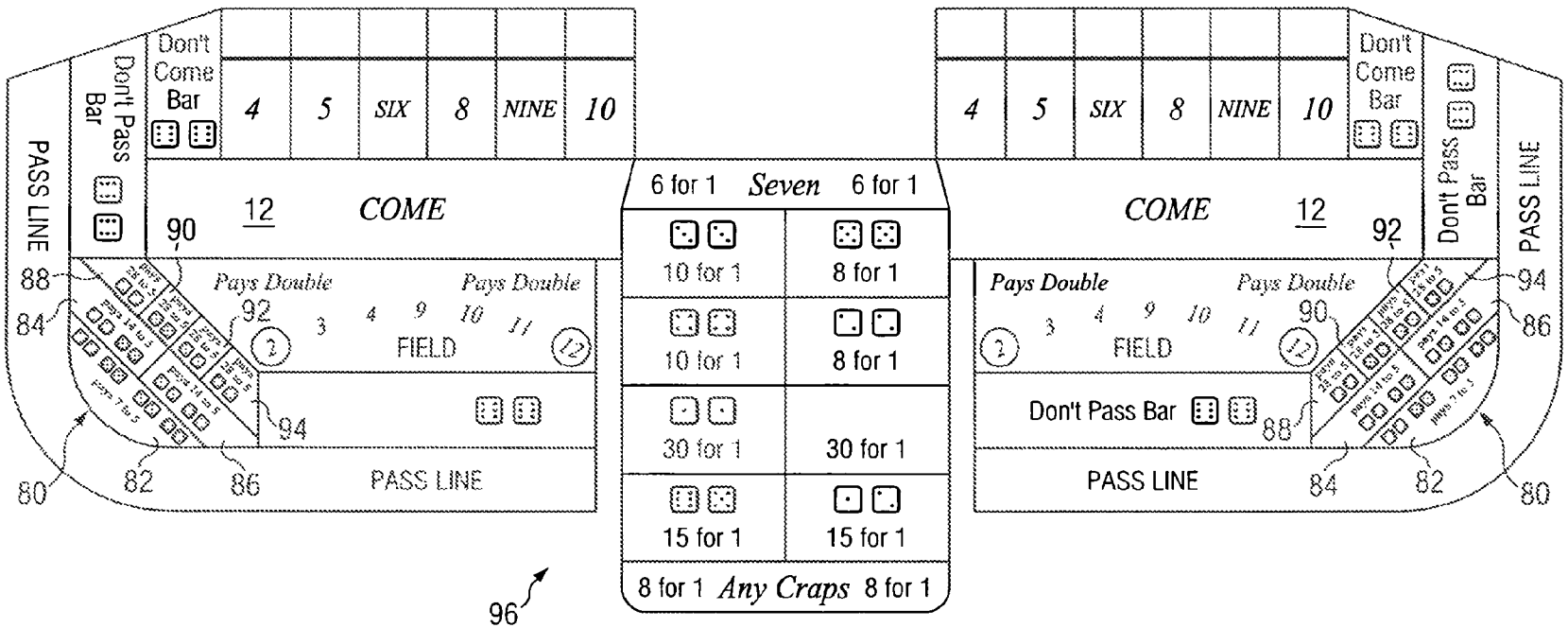
FIG. 9 is an illustration of a craps table incorporating the wagering opportunity shown in FIG. 8.

FIG. 9 illustrates a craps table 96 incorporating the embodiment of the present invention illustrated in FIG. 8. The craps table 96 is identical to the craps table 10 of FIG. 1 except that the craps table segment 80 shown in FIG. 8 replaces both of the craps table segments 14 shown in FIG. 1. The use of the craps table 96 of FIG. 9 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 10A:
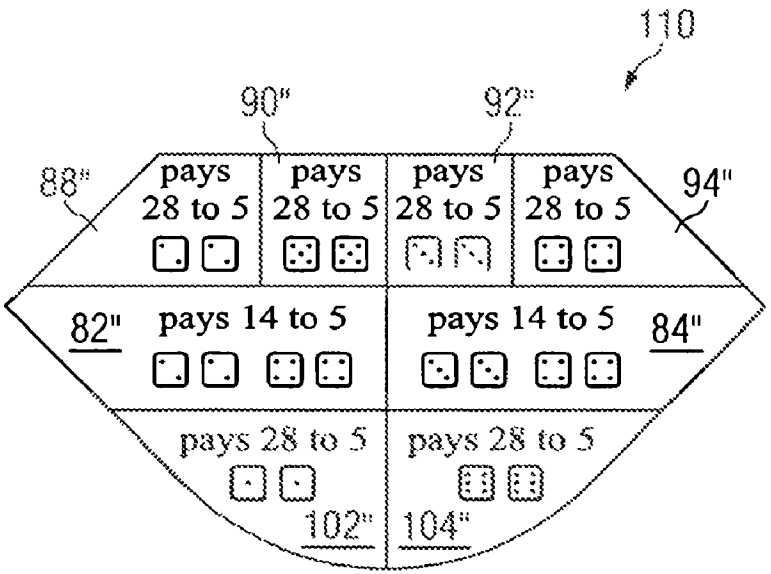
FIG. 10A is an illustration of a variation of the novel craps wagering opportunity shown in FIG. 10.
Figure 10:
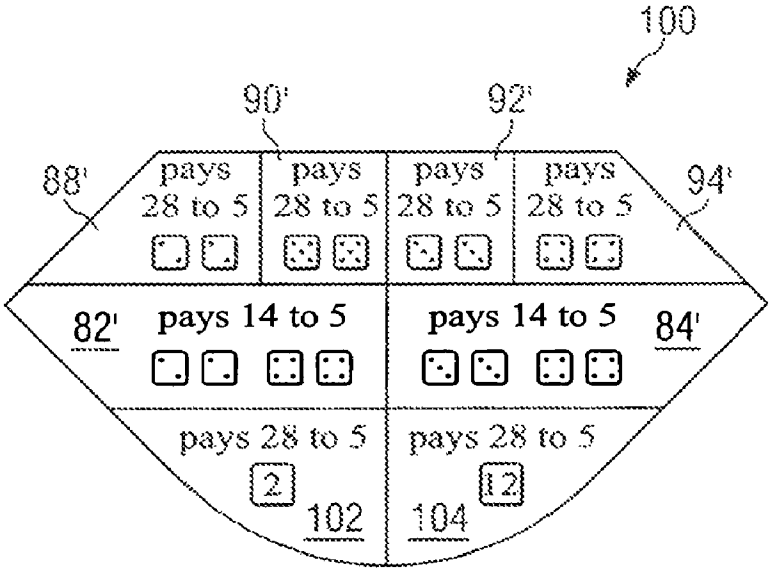
FIG. 10 is an illustration of a variation of the novel craps wagering opportunity shown in FIG. 8.

FIG. 10 illustrates a craps table segment 100 similar to the craps table segment 80 illustrated in FIG. 8. Many of the portions of the craps table segment 100 are substantially identical in construction and function to the portions of the craps table segment 80 illustrated in FIG. 8 described hereinabove in conjunction therewith. Such identical component parts are designated in FIG. 10 with the same reference numerals utilized above in the description of the craps table segment 80, but are differentiated therefrom by means of a prime (') designation.

The craps table segment 100 differs from the craps table segment 80 of FIG. 8 in that the craps table segment 100 offers two additional betting options. The portion 102 allows the player to wager that the number two will be rolled via double ones before a seven is thrown. The portion 104 allows the player to wager that a twelve will be rolled via double sixes before a seven is thrown. Both the portion 102 and portion 104 award a 28 to 5 payout plus the amount of the original bet if the chosen number and dice combination is thrown before the shooter throws a seven. As will therefore be understood by those skilled in the art the bets provided to the craps player by this embodiment of the present invention resemble, in some respects, the conventional "place" bet.

FIG. 10*a* illustrates a craps table segment 110 similar to the craps table segment 100 illustrated in FIG. 10. Many of the portions of the craps table segment 110 are substantially identical in construction and function to the portions of the craps table segment 100 illustrated in FIG. 10 described hereinabove in conjunction therewith. Such identical component parts are designated in FIG. 10*a* with the same reference numerals utilized above in the description of the craps table segment 100, but are differentiated therefrom by means of a double prime (") designation.

The craps table segment 110 differs from the craps table segment 100 of FIG. 10 in that the craps table segment 110 illustrates the numeral two in the portion 102" with each die showing the number one, and the portion 104" illustrates the number twelve with each die showing the number six.

Figure 11:
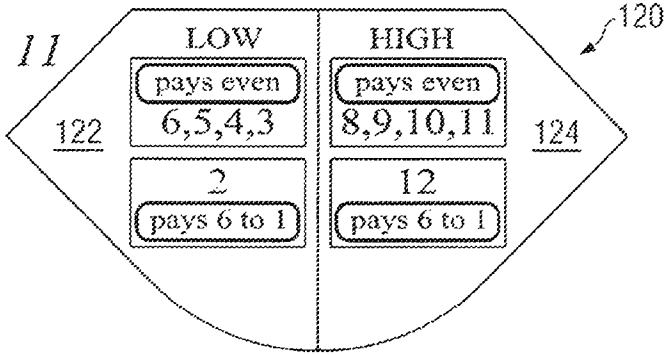
FIG. 11 is an illustration of yet another novel craps wagering opportunity comprising the present invention.

FIG. 11 illustrates a craps table segment 120 intended as a replacement for the segments 14 of the craps table 10 shown in FIG. 1. The segment 120 includes a low portion 122 and a high portion 124 By placing one or more chips on the low portion 122 the player wagers that a two, a three, a four, a five, or a six will be thrown on the next roll of the dice during the play of the craps game. If a two is thrown on the next roll the player receives a payout equal to six times the original wager while retaining the original wager. If a three, a four, a five, or a six is thrown on the next roll, the player receives a payout equal to the amount of the original wager.

If a player places one or more chips on the high portion 124 of the segment 120 the player wagers that an eight, a nine, a ten, an eleven, or a twelve will be thrown on the next roll of the dice during the play of the craps game. If a twelve is thrown on the next roll during play of the craps game the player receives a payout equal to six times the original wager while retaining the original wager. If an eight, a nine, a ten, or an eleven is thrown on the next roll during play of the craps game, the player receives a payout equal to the amount of the original wager. As will therefore be understood by those skilled in the art the bets provided to the craps player by this embodiment of the present invention resemble, in some respects, the conventional "field" bet.

Figure 12:
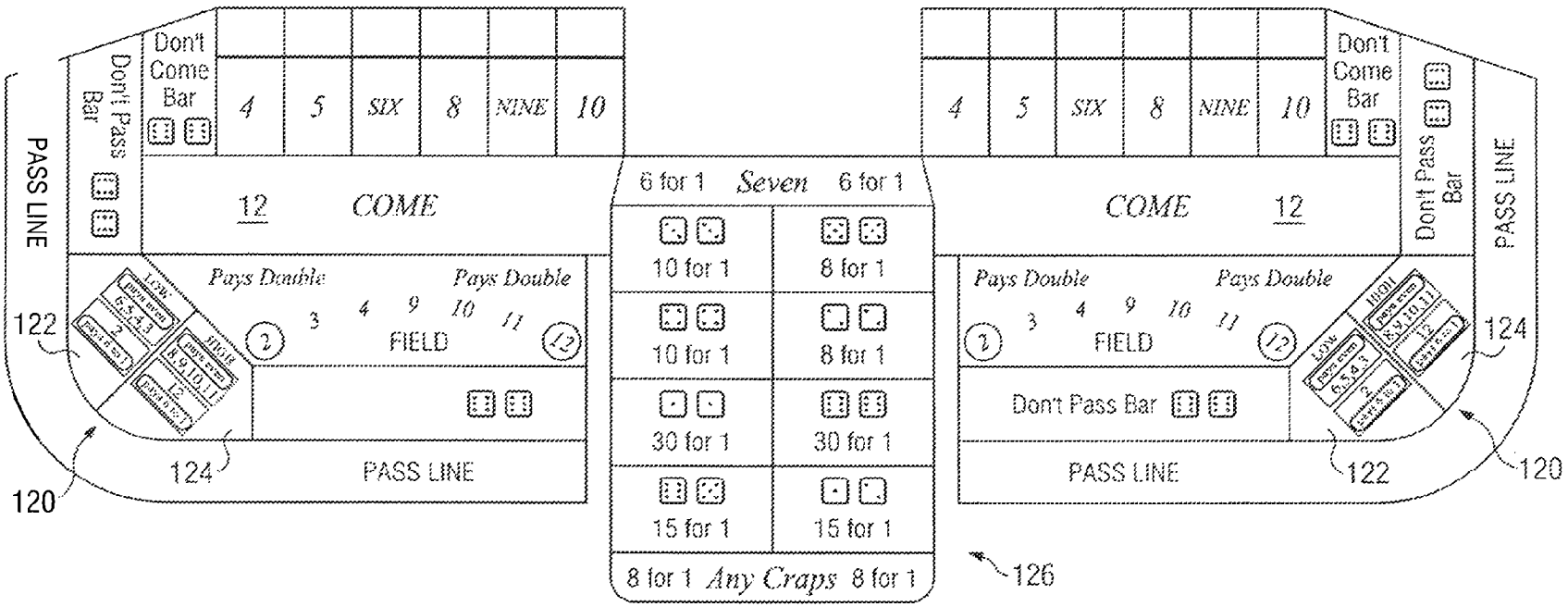
FIG. 12 is an illustration of a craps table incorporating the wagering opportunity shown in FIG. 11.

FIG. 12 illustrates a craps table 126 incorporating the embodiment of the present invention illustrated in FIG. 11. The craps table 126 is identical to the craps table 10 of FIG. 1 except that the craps table segment 120 shown in FIG. 11 replaces both of the craps table segments 14 shown in FIG. 1. The use of the craps table 126 of FIG. 12 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 13:
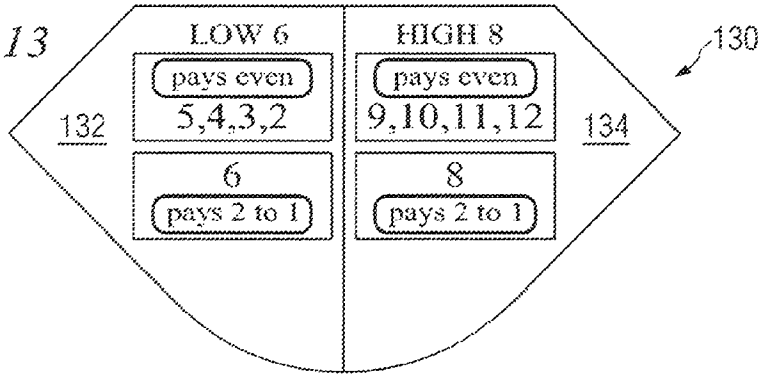
FIG. 13 is an illustration of yet another novel craps wagering opportunity comprising the present invention.

FIG. 13 illustrates a craps table segment 130 intended as a replacement for the segments 14 of the craps table 10 shown in FIG. 1. The segment 130 includes a low six portion 132 and a high eight portion 134 By placing one or more chips on the low six portion 132 the player wagers that a two, a three, a four, a five, or a six will be thrown on the next roll of the dice during the play of the craps game. If a six is thrown on the next roll, the player receives a payout equal to two times the original bet while retaining the original bet. If a two, three, a four, or a five is thrown on the next roll, the player receives a payout equal to the amount of the original bet.

If a player places one or more chips on the high eight portion 134 of the segment 130, the player wagers that an eight, nine, a ten, an eleven, or a twelve will be thrown on the next roll of the dice during the play of the craps game. If an eight is thrown on the next roll during play of the craps game, the player receives a payout equal to two times the original bet while retaining the original bet. If a nine, a ten, an eleven, or a twelve is thrown on the next roll during play of the craps game, the player receives a payout equal to the amount of the original bet.

Figure 14:
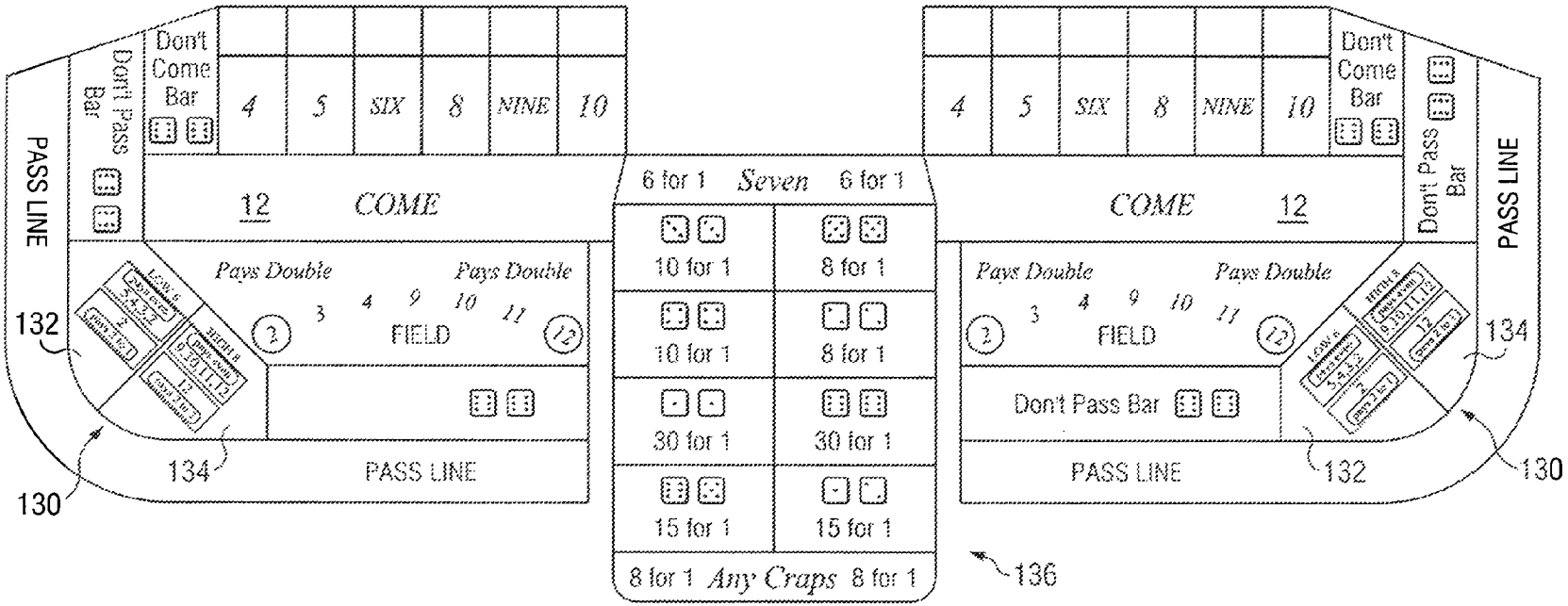
FIG. 14 is an illustration of a craps table incorporating the wagering opportunity shown in FIG. 13.

FIG. 14 illustrates a craps table 136 incorporating the embodiment of the present invention illustrated in FIG. 13. The craps table 136 is identical to the craps table 10 of FIG. 1 except that the craps table segment 130 shown in FIG. 13 replaces both of the craps table segments 14 shown in FIG. 1. The use of the craps table 136 of FIG. 13 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 15:
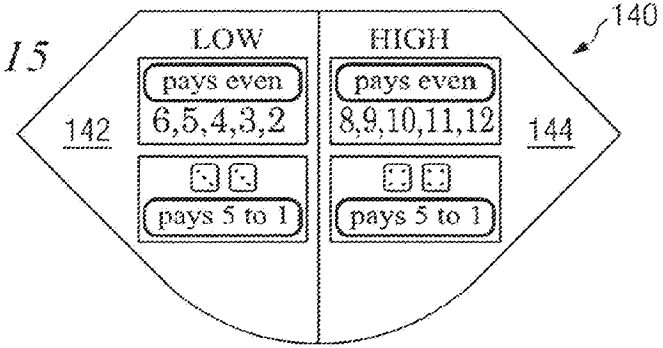
FIG. 15 is an illustration of yet another novel craps wagering opportunity comprising the present invention.

FIG. 15 illustrates a craps table segment 140 intended as a replacement for the segments 14 of the craps table 10 shown in FIG. 1. The segment 140 includes a low portion 142 and a high portion 144 By placing one or more chips on the low portion 142 the player wagers that a two, a three, a four, a five, or a six will be thrown on the next roll of the dice during the play of the craps game. If a six is thrown on the next roll by throwing doubles, the player receives a payout equal to five times the original bet while retaining the original bet. If a two, a three, a four, a five, or a six is thrown on the next roll, the player receives a payout equal to the amount of the original bet.

If a player places one or more chips on the high portion 144 of the segment 140, the player wagers that an eight, nine, a ten, an eleven, or a twelve will be thrown on the next roll of the dice during the play of the craps game. If an eight is thrown on the next roll by throwing doubles during play of the craps game, the player receives a payout equal to five times the original bet while retaining the original bet. If an eight, a nine, a ten, an eleven, or a twelve is thrown on the next roll during play of the craps game, the player receives a payout equal to the amount of the original bet.

Figure 16:
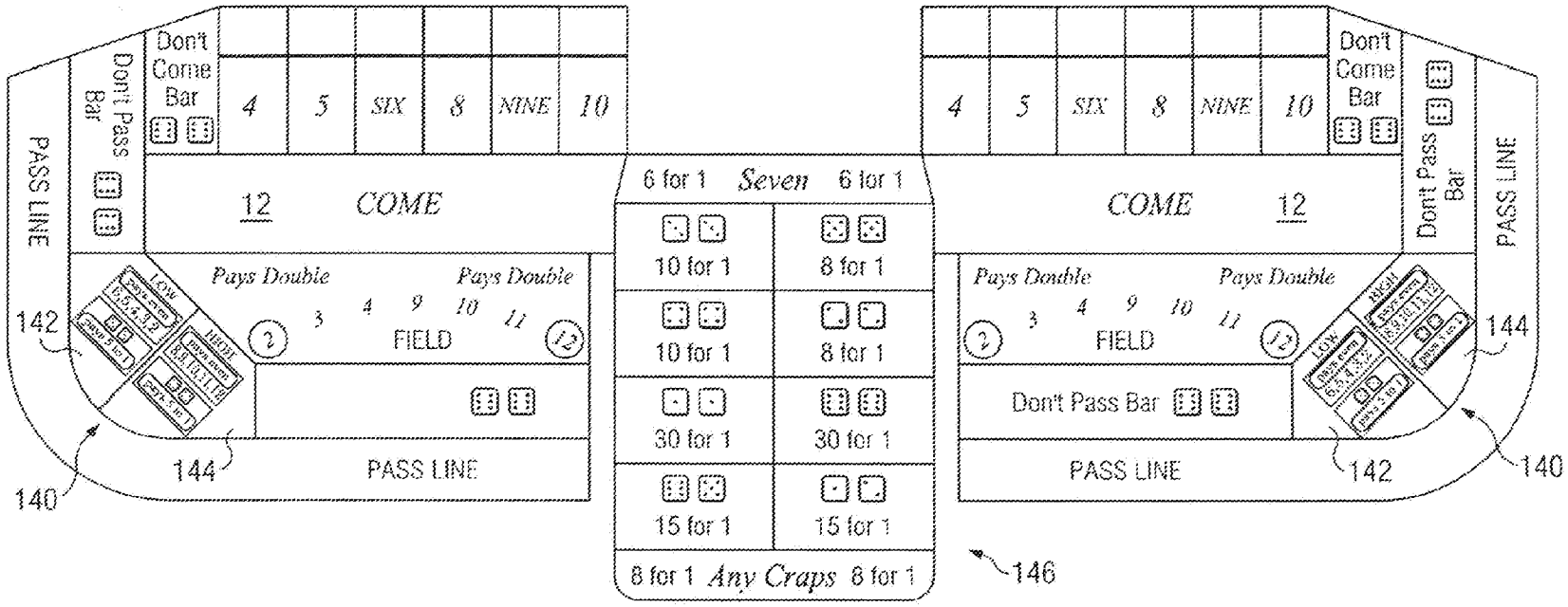
FIG. 16 is an illustration of a craps table incorporating the wagering opportunity shown in FIG. 15.

FIG. 16 illustrates a craps table 146 incorporating the embodiment of the present invention illustrated in FIG. 15. The craps table 146 is identical to the craps table 10 of FIG. 1 except that the craps table segment 140 shown in FIG. 15 replaces both of the craps table segments 14 shown in FIG. 1. The use of the craps table 146 of FIG. 15 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 17:
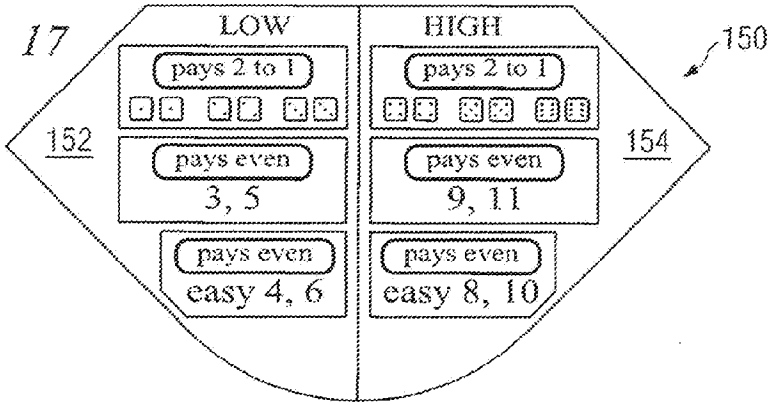
FIG. 17 is an illustration of yet another novel craps wagering opportunity comprising the present invention.

FIG. 17 illustrates a craps table segment 150 intended as a replacement for the segments 14 of the craps table 10 shown in FIG. 1. The segment 150 includes a low portion 152 and a high portion 154. By placing one or more chips on the low portion 152 the player wagers that a two, a three, a four, a five, or a six will be thrown on the next roll of the dice during the play of the craps game. If a two, a four, or a six is thrown on the next roll by throwing doubles the player receives a payout equal to two times the original bet while retaining the original bet. If a three or a five is thrown on the next roll, the player receives a payout equal to the amount of the original bet. If a four or a six is thrown on the next roll in a form other than by throwing doubles, the player receives a payout equal to the amount of the original bet.

If a player places one or more chips on the high portion 154 of the segment 150 the player wagers that an eight, a nine, a ten, an eleven, or a twelve will be thrown on the next roll of the dice during the play of the craps game. If an eight, a ten, or twelve is thrown on the next roll by throwing doubles the player receives a payout equal to two times the original bet while retaining the original bet. If a nine or an eleven is thrown on the next roll the player receives a payout equal to the amount of the original bet. If an eight or ten is thrown on the next roll in a form other than by throwing doubles the player receives a payout equal to the amount of the original bet.

Figure 18:
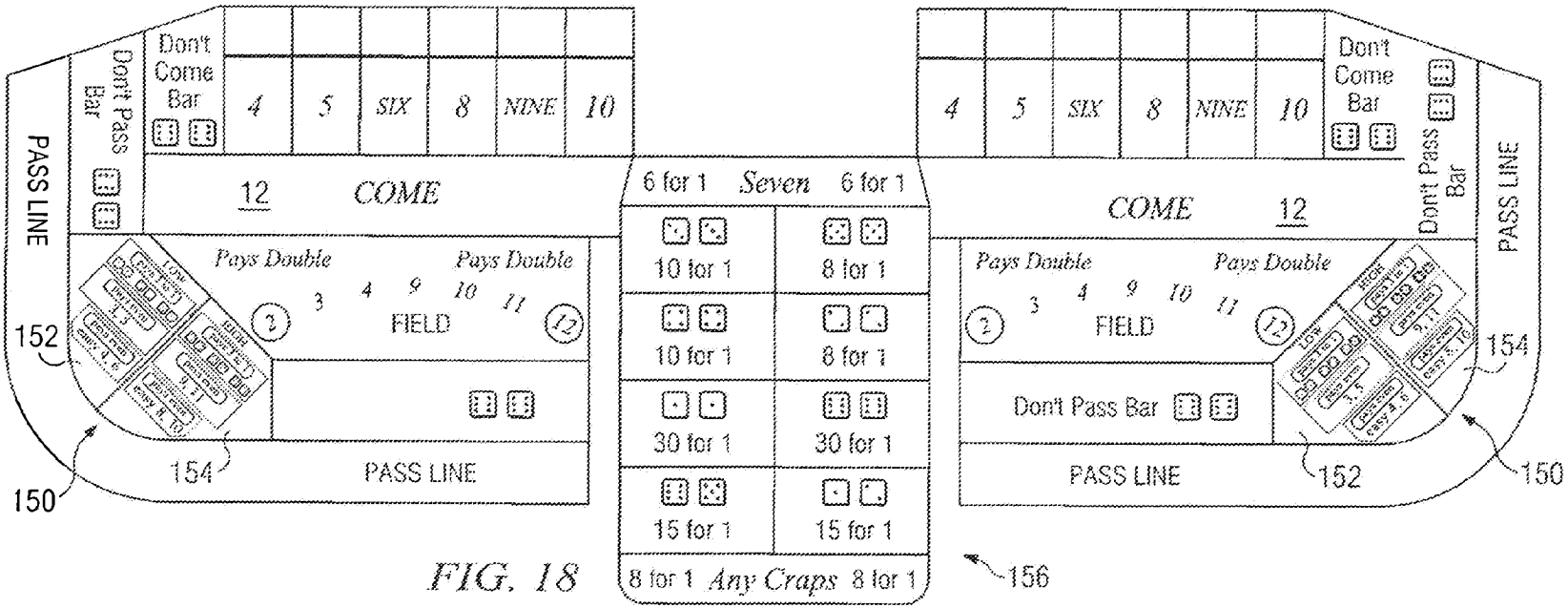
FIG. 18 is an illustration of a craps table incorporating the wagering opportunity shown in FIG. 17.

FIG. 18 illustrates a craps table 156 incorporating the embodiment of the present invention illustrated in FIG. 17. The craps table 156 is identical to the craps table 10 of FIG. 1 except that the craps table segment 150 shown in FIG. 17 replaces both of the craps table segments 14 shown in FIG. 1. The use of the craps table 156 of FIG. 18 is highly advantageous both to the player and to the table operator as compared with the use of the craps table 10 of FIG. 1. The advantages to both the player and table operator are substantially similar to the advantages gained by operating the craps table 30 shown in FIG. 3 and described hereinabove in conjunction therewith.

Figure 19:
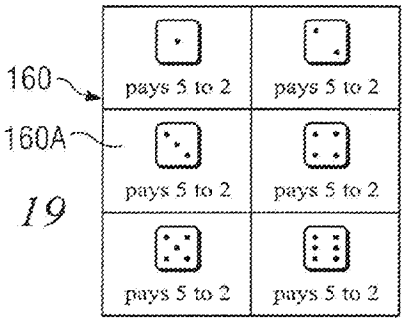
FIG. 19 is an illustration of yet another novel craps wagering opportunity comprising the present invention.

FIG. 19 illustrates a craps table segment 160 intended as a replacement for the segments 14 of the craps table 10 shown in FIG. 1. The segment 60 comprises six subparts each illustrating one face of a conventional die used in the game of craps. The segment 160 allows a craps player to wager that at least one die comprising the two dice that will be thrown on the next roll in the craps game will display the selected number. If a craps player places one or more chips on the segment 160A the player wagers that at least one of the two dice thrown on the next roll of the craps game will display a "3". If in fact one of the two dice thrown on the next roll comprising the craps game is a "3" the player wins the wager. If not, the player loses the wager.

Figure 20:
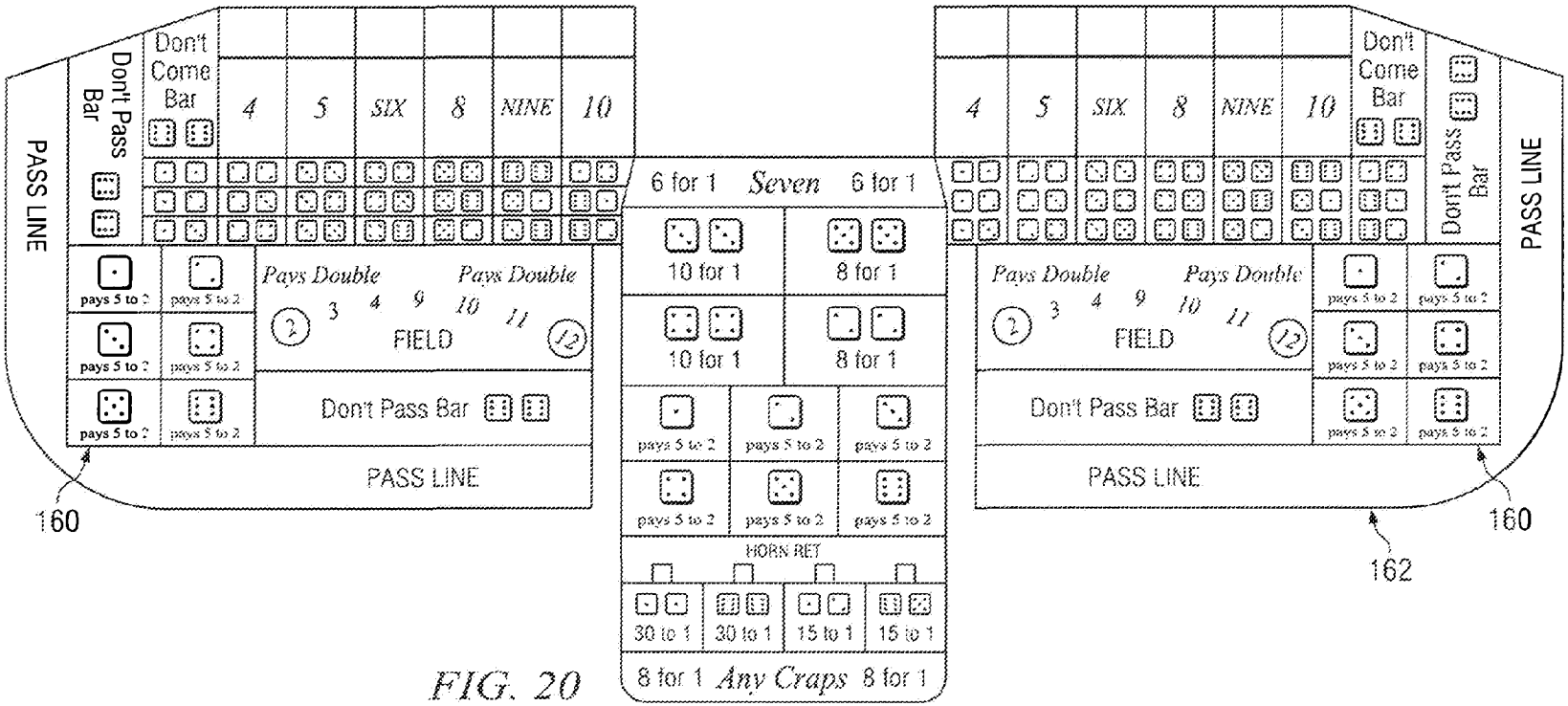
FIG. 20 is an illustration of a craps table incorporating the wagering opportunity of FIG. 19.

FIG. 20 illustrates a craps table 162 incorporating the embodiment of the present invention illustrated in FIG. 19. The craps table 162 is identical to the craps table 10 of FIG. 1 except that the craps table segment 160 shown in FIG. 19 replaces both of the craps table segments 14 shown in FIG. 1. The use of the craps table 162 of FIG. 20 is highly advantageous to both the player and to the operator as compared with the use of the craps table 10 of FIG. 1. The advantages to both the player and the table operator are substantially similar to the advantages gained by operating the craps table 30 shown in FIG. 3 and described hereinabove in conjunction therewith.

Figure 21:
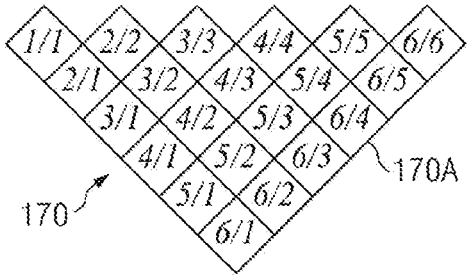
FIG. 21 is an illustration of yet another novel craps wagering opportunity comprising the present invention.

FIG. 21 illustrates a tracking grid 170 comprising an aspect of the present invention that is highly advantageous to the craps table operator. At the completion of each roll of the dice an employee of the craps table operator that is responsible for operation of the craps table places a marker on the segment of the tracking grid 170 corresponding to the combination of dice that was just rolled. For example, if a particular roll of the dice causes a 6 and a 4 to be displayed the employee places a marker on tracking grid segment 170A. In this manner arguments between one or more craps players and the employees of the table operator that are responsible for managing the craps table are completely eliminated.

The tracking grid 170 is also useful in the management of "hop bets". As is well known to those skilled in the art a hop bet comprises a wager that a specific combination of dice will be thrown on the next roll of the dice.

As will be readily understood by those skilled in the art the tracking grid 170 is utilized when placing a hop bet prior to the roll of the dice. A player wishing to make a hop bet places one or more chips on the segment of the tracking grid 170 corresponding to the wager that he or she wishes to make. Assuming that the combination of dice that is displayed on the next roll of the dice matches the hop bet the employees of the table operator make the appropriate payout to the player that made the wager, remove all of the chips from the tracking grid 170, and place a marker on the segment, and place marker on the segment of the tracking grid 170 corresponding to the combination of dice that was just rolled. The marker remains in place until the next roll of the dice thereby eliminating confusion and arguments over exactly what combination of die was thrown on a previous roll.

Figure 22:
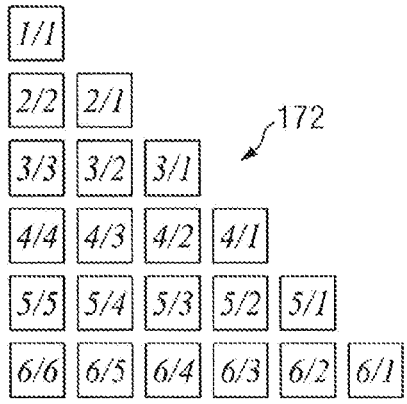
FIG. 22 is an illustration of a variation of the craps wagering opportunity of FIG. 21.
Figure 23:
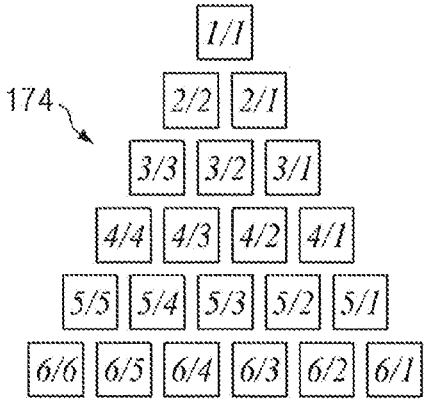
FIG. 23 is an illustration of another variation of the wagering opportunity of FIG. 21.
Figure 24:
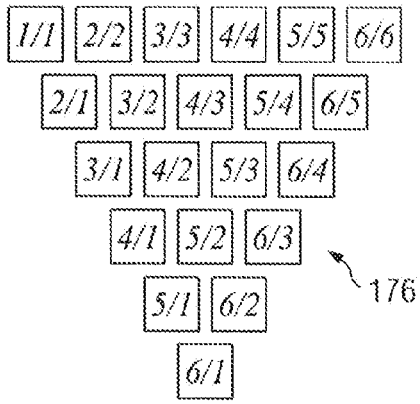
FIG. 24 is an illustration of yet another variation of the wagering opportunity of FIG. 21.

FIG. 22 illustrates a tracking grid 172 which is similar to the tracking grid 170 shown in FIG. 21 and described hereinabove but comprising a different arrangement of the segments comprising the tracking grid. FIG. 23 illustrates a tracking grid 174 which is similar to the tracking grid 170 shown in FIG. 21 and described hereinabove but comprising a different arrangement of the segments comprising the tracking grid. FIG. 24 illustrates a tracking grid 176 which is similar to the tracking grid 170 shown in FIG. 21 and described hereinabove but comprising a different arrangement of the segments comprising the tracking grid.

Figure 25:
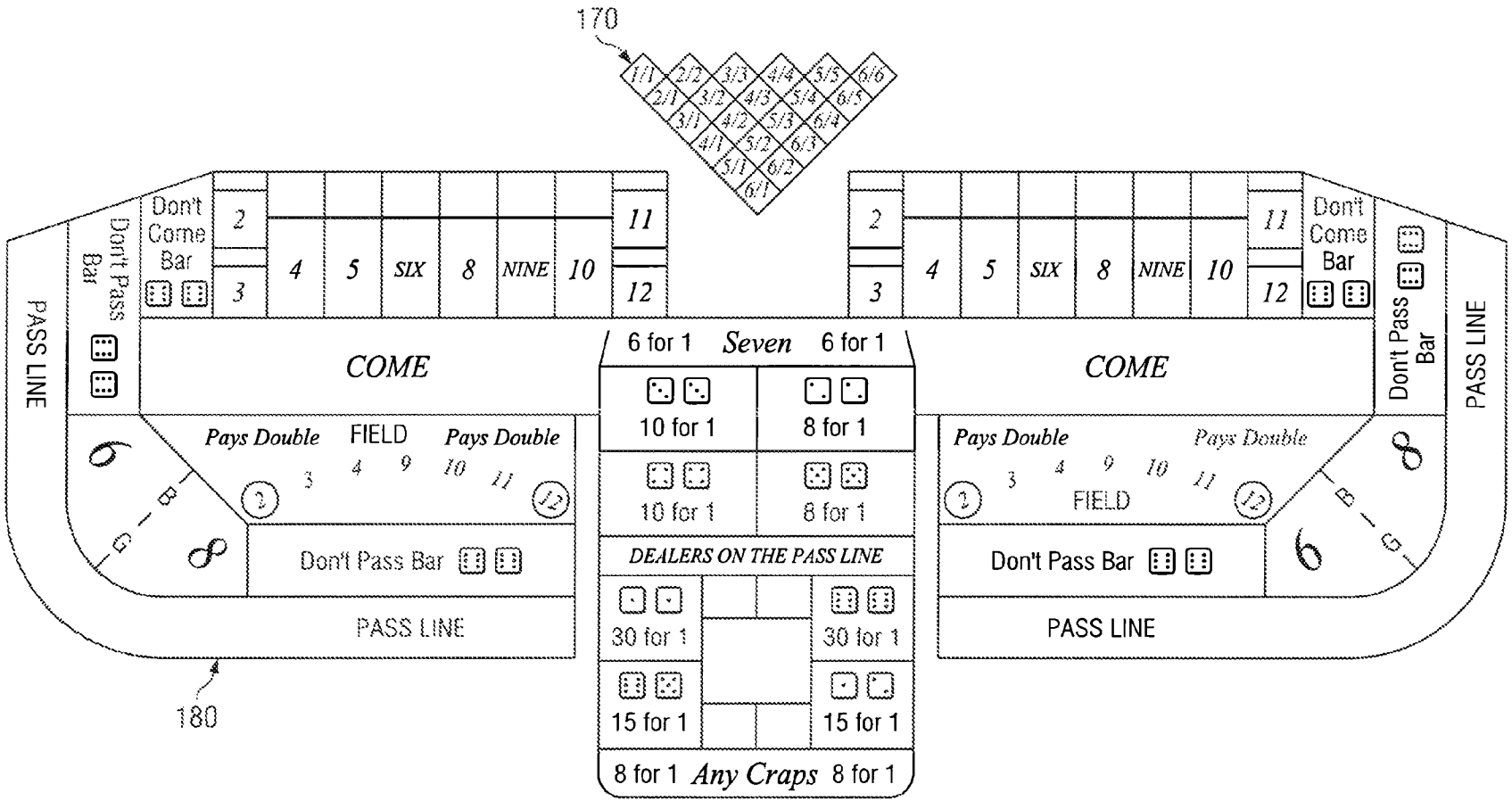
FIG. 25 is an illustration of a craps table incorporating the wagering opportunity of FIG. 21.

FIG. 25 illustrates a craps table 180 equipped with the tracking grid 170 of FIG. 21. As described in detail above the use of the tracking grid 170 in conjunction with the craps table 180 is advantageous in eliminating confusion and arguments as to the specific combination of numerals that was thrown on the last roll of the dice and in facilitating hop bets. As will be appreciated by those skilled in the art the tracking grids 172, 174 and 176 illustrated in FIGS. 22, 23, and 24, respectively, can be used in combination with the craps table 180 in lieu of the tracking grid 170 depending upon the requirements of particular applications of the invention.

Figure 26:
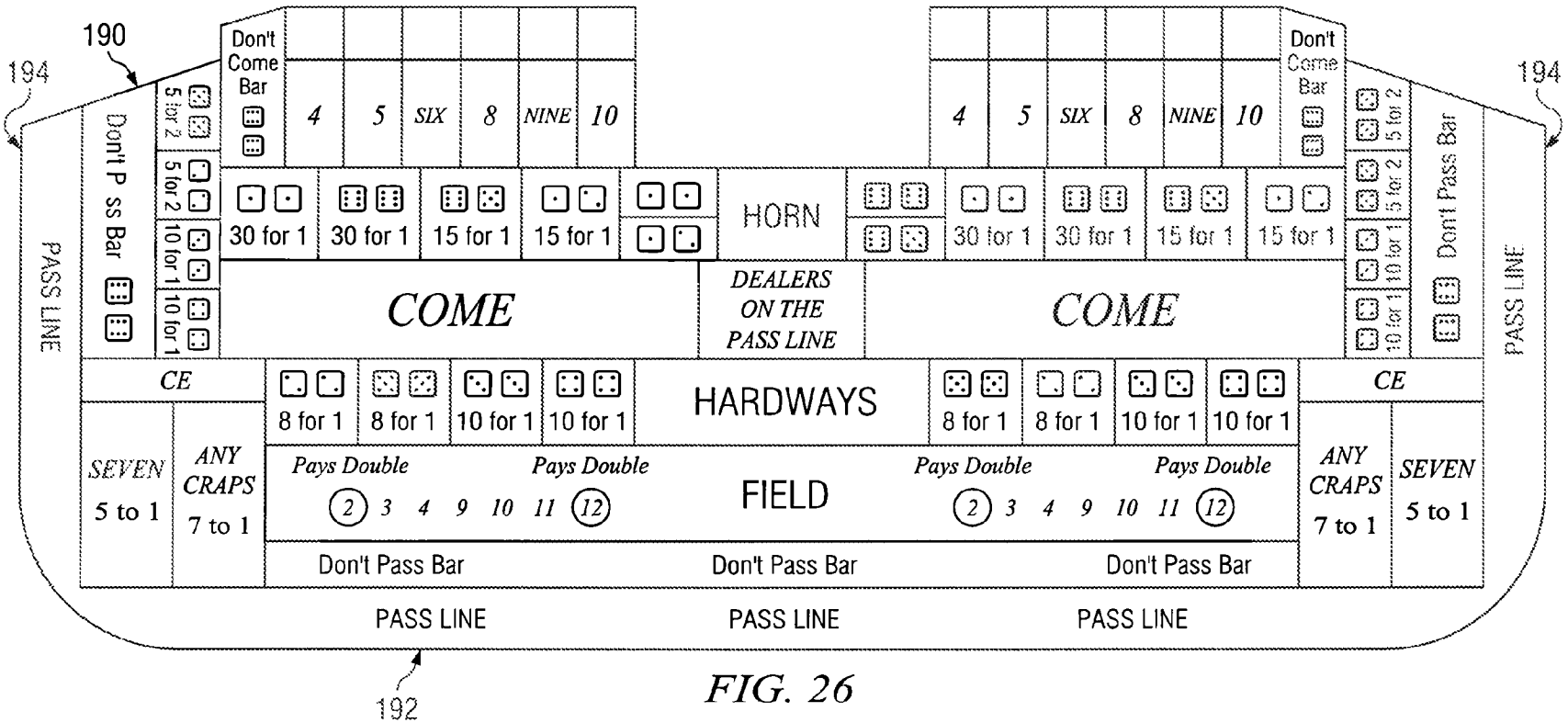
FIG. 26 is an illustration of a novel craps table layout comprising yet another embodiment of the present invention.

FIG. 26 illustrates a craps table layout 190 that is both highly convenient to craps players and highly advantageous to the operator of the craps table. The craps table layout 190 places the wagering opportunities most favored by craps players close to the front 192 and the sides 194 of the craps table. Craps players to place their own wagers as opposed to having wagers placed on their behalf by employees of the craps table operator as is the case in the operation of conventional craps table layouts.

Because the craps table 190 allows craps players to place their own wagers in the vast majority of cases a craps table incorporating the craps table layout 190 can be operated by three employees of the craps table operator as opposed to the usual four employee requirement. Thus, the craps table operator enjoys a 25% reduction in employee costs when utilizing the craps table layout 190 as opposed to conventional craps table layouts. The craps table layout 190 also allows a substantially greater number of craps players to position themselves around a craps table incorporating the craps table layout 190 as compared with craps tables incorporating traditional craps table layouts the revenues received and profits earned by the craps table operator.

Figure 27:
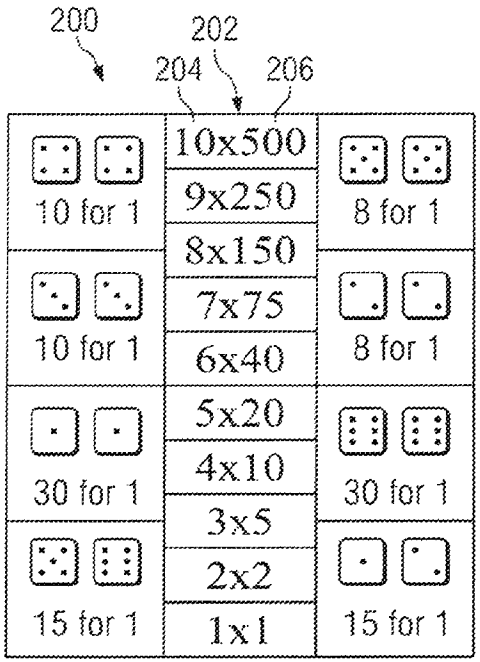
FIG. 27 is an illustration of yet another novel craps wagering opportunity comprising the present invention.

Referring to FIG. 27 there is shown a craps table segment 200 incorporating the present invention. As will appreciated by those skilled in the art, the craps table segment 200 is intended as a replacement for the segment 16 of the craps table 10 shown in FIG. 1 whereby additional wagering opportunities are afforded by means of the present invention.

The segment 200 contains a segment 202 in the middle that contains two sets of numbers. The left portion 204 comprises the numbers 1 through 10. The right portion 206 comprises the numbers 1, 2, 5, 10, 20, 40, 75, 150, 250, and 500. Portion 204 represents the number of consecutive passes. Portion 206 represents the multiplying number used to determine the value of a wager at that time. Example: A $5 wager after 4 consecutive passes would have a value of ($5×10) or ($50)+ original $5 wager returned. The multiplying number of 10 is determined by looking at the segment 202 and the multiplier in the portion 206 adjacent to the number 4 in the portion 204 representing four consecutive passes.

Segment 202 is the area incorporating the present invention. In placing the wager the dealer places a marker that identifies the player that the wager belongs to. If a pass is made the marker is moved up one section to the number that represents the current number of passes that have been made, and the corresponding multiplying number is used to determine the value of the wager. At any time before a point is established the wager can be collected for its current value. After a point is established a win or loss for that pass is determined before the wager can be collected with failure to make a pass resulting in the loss of the wager. The addition of the wager comprising FIG. 27 does not affect the normal play of a craps game but does make the game more exciting with a potential payoff that exceeds all other payoffs on the table.

Figure 28:
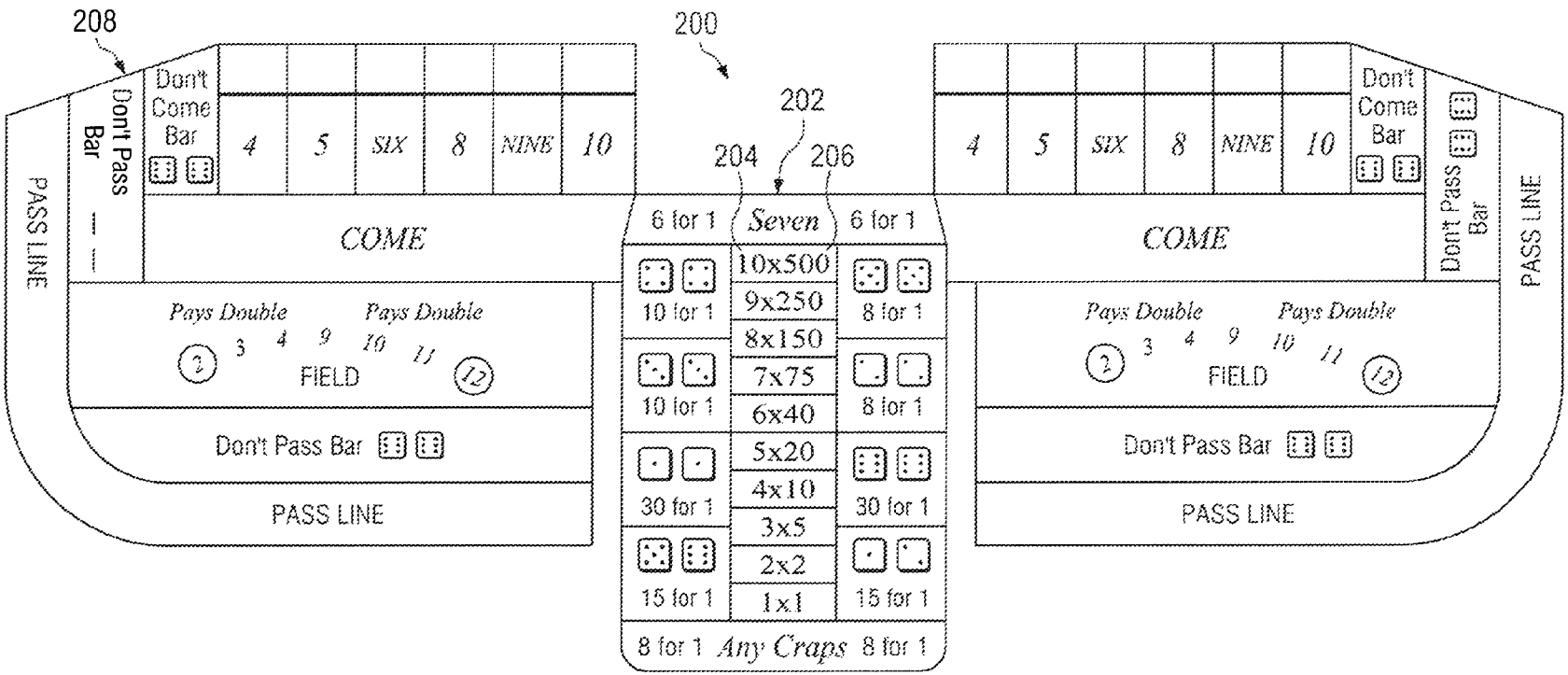
FIG. 28 is an illustration of a craps table incorporating the wagering opportunity of FIG. 27.

FIG. 28 illustrates a craps table 208 incorporating the present invention. The craps table 208 is identical to the craps table 10 of FIG. 1 except that the craps table segment 200 shown in FIG. 27 replaces the craps table segment 16 shown in FIG. 1.

The use of the craps table 208 of FIG. 28 is highly advantageous both to the player and to the operator as compared with the use of the craps table 10 of FIG. 1. With respect to the craps player, the use of the segment 200 and the wagering opportunities afforded by means of the present invention provides higher payout opportunities. With respect to the craps table operator the use of the segment 200 and the wagering opportunities of the present invention attract more players to the craps table which ultimately results in a larger return to the table operator.

Figure 29:
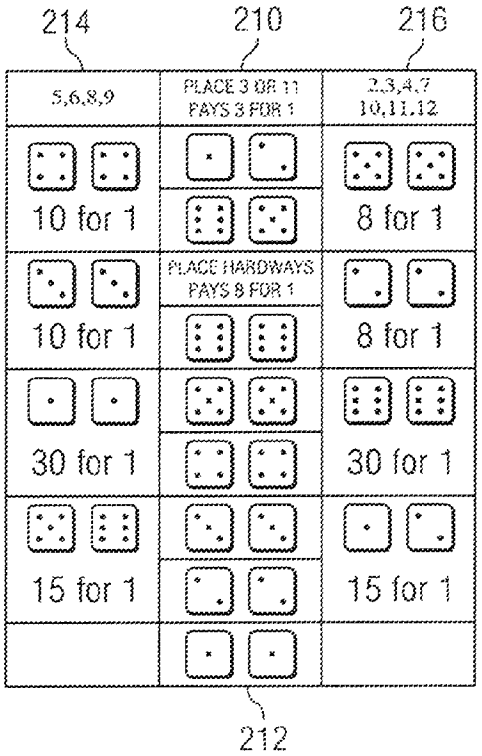
FIG. 29 is an illustration of yet another novel craps wagering opportunity comprising the present invention.

Referring to FIG. 29 segment 210 illustrates additional waging opportunities that allow a player to wager that a 3 or an 11 will be rolled before a 7 is rolled. Segment 212 provides waging opportunities that allow a player to wager on any of the possible combinations of dice in which the number on top of one die is equal to the number on top of the other die. Example: a 4 being rolled with a 2 on one die and a 2 on the other die. This differs from the hardways bet in that only a 7 results in a loss of the wager. The payoff is less, but the lower percentage return for the craps table operator and is lower, with the end result being more advantageous for the player. This results in more wagers and ultimately more profit for the craps table operator.

FIG. 29 also includes segments 214 and 216 each containing a set of numbers. If a player wagers in either segment 214 or 216 and one of the numbers contained therein is rolled the payout comprises an amount equal to the amount wagered less 5%. The wager is lost if any number other than the numbers comprising the selected segment is rolled on the next roll of the dice.

Figure 30:
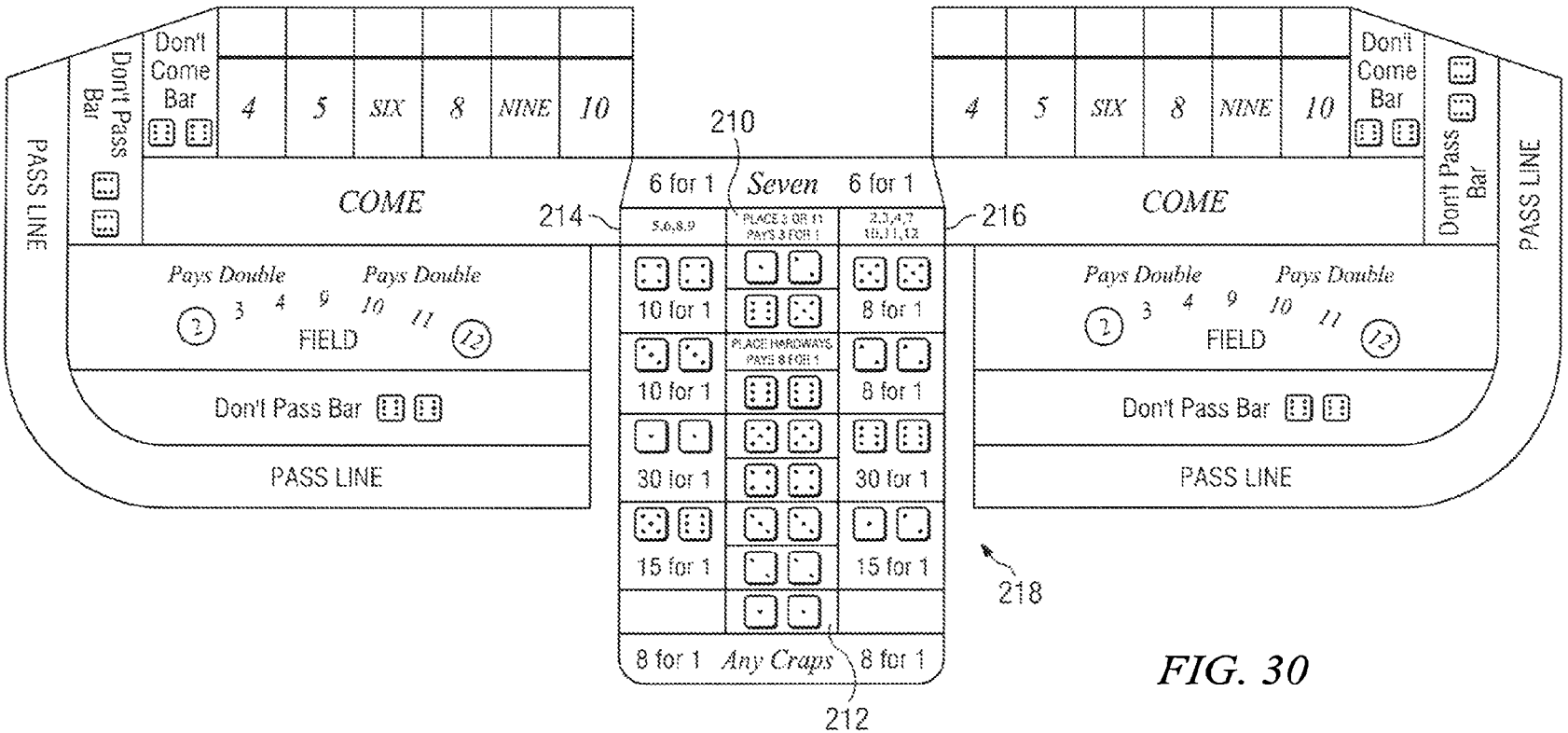
FIG. 30 is an illustration of a craps table incorporating the wagering opportunity of FIG. 29.

FIG. 30 illustrates a craps table 218 incorporating the present invention. The craps table 218 is identical to the craps table 10 of FIG. 1 except that the craps table segment 218 shown in FIG. 29 replaces the craps table segment 16 shown in FIG. 1.

The use of the craps table 218 of FIG. 28 is highly advantageous both to the player and to the operator as compared with the use of the craps table 10 of FIG. 1. With respect to the craps player, the use of the segment 218 and the wagering opportunities afforded by means of the present invention provides higher payout opportunities. With respect to the craps table operator the use of the segment 218 and the wagering opportunities of the present invention attract more players to the craps table which ultimately results in a larger return to the table operator.

Figure 31:
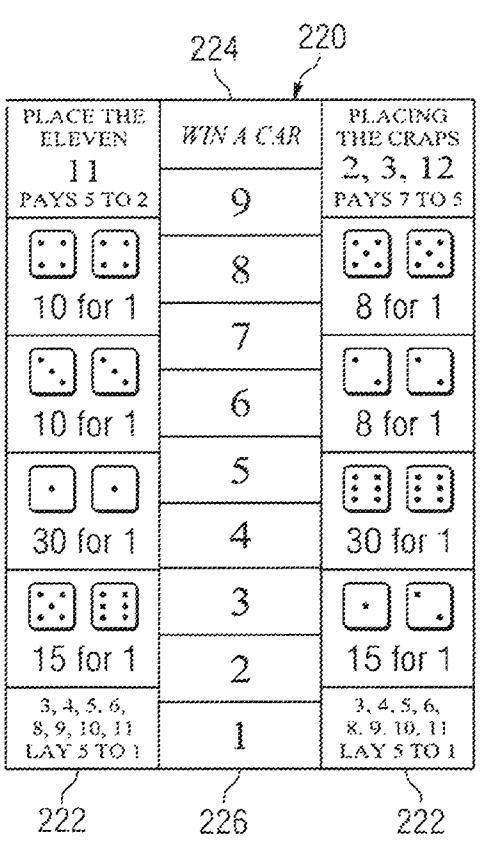
FIG. 31 is an illustration of yet another novel craps wagering opportunity comprising the present invention.

Referring to FIG. 31, segment 220 contains a set of numbers comprising 3, 4, 5, 6, 8, 9, 10, and 11. A wager made in either segment 220 wins if any one of the numbers in the set is rolled before a seven, but if a seven is rolled the wager is lost. The roll of a 2 or a 12 has no effect on the wager. To make this wager a player has to lay 5 to 1. Example: $5 is wagered, and one of the numbers in that set is rolled. The player wins and is paid $1, but if a seven is rolled the wager is lost and the player loses the $5.

Still referring to FIG. 31 segment 222 on the craps table an opportunity to wager for car. Other jackpot type prizes offered in lieu of a car. The craps table operator selects the prize. Segment 226 of segment 220 is used to track of the bet that is offered by the craps table operator depending on the cost of the car or other jackpot prize that is offered in segment 224. Example: To win a Chevrolet truck the craps table operator might require a shooter to roll 5 consecutive elevens. A Porsche would require that ten consecutive elevens are rolled. The wager would vary but in any event several consecutive rolls would be required to win the prize designated in segment 224.

Figure 33:
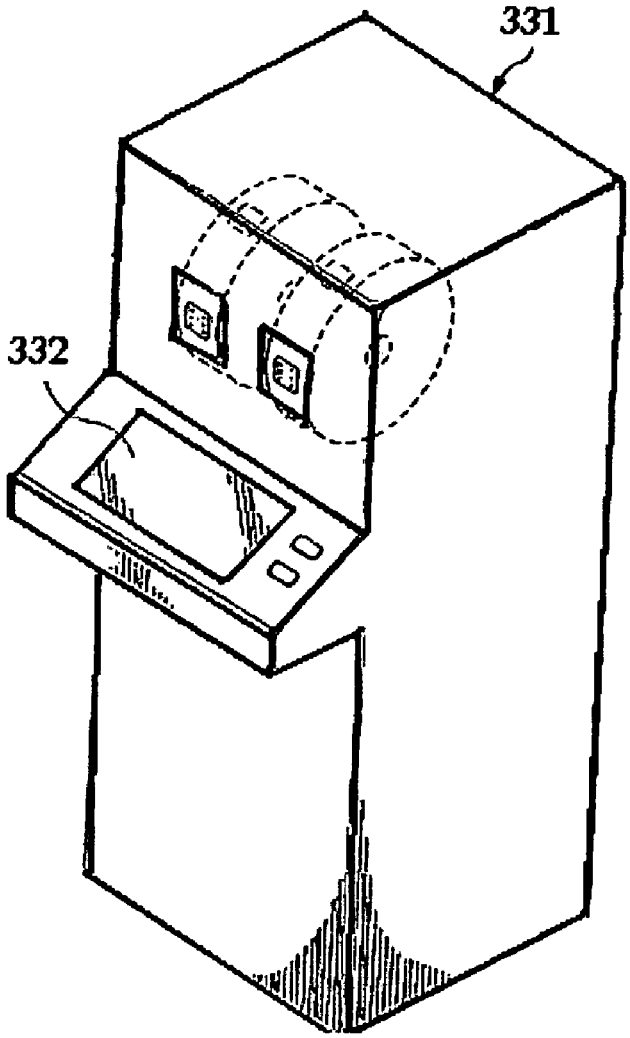
FIG. 33 is a illustration of a gaming machine.

Referring to FIG.33-331 is an gaming machine with a video display (FIG.33-332) used to perform the tasks described in this embodiment. The type of machine can have different sizes or shapes or the number of persons that can play at the same time.

Although the present invention is described in conjunction with a game of chance played using a pair of dice, the present invention is equally applicable to a craps game of chance played with playing cards instead of dice wherein the player's wager and payout depend on the next cards dealt rather than the next roll of the dice.

Figure 32:
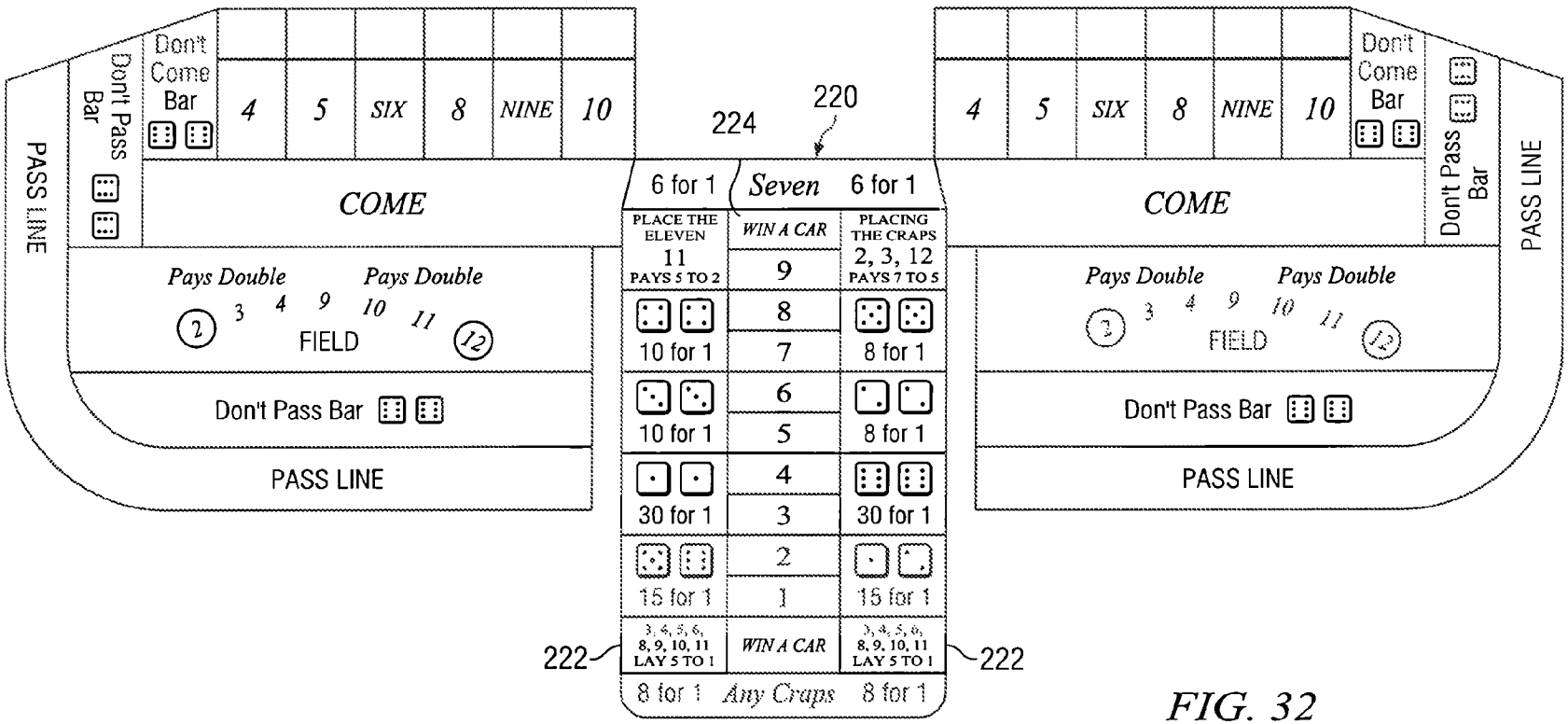
FIG. 32 is an illustration of a craps table incorporating the wagering opportunity of FIG. 31.

FIG. 32 illustrates a craps table 224 incorporating the present invention. The craps table 224 is identical to the craps table 10 of FIG. 1 except that the craps table segment 224 shown in FIG. 29 replaces the craps table segment 16 shown in FIG. 1.

The use of the craps table 208 of FIG. 28 is highly advantageous both to the player and to the operator as compared with the use of the craps table 10 of FIG. 1. With respect to the craps player, the use of the segment 224 and the wagering opportunities afforded by means of the present invention provides higher payout opportunities. With respect to the craps table operator the use of the segment 224 and the wagering opportunities of the present invention attract more players to the craps table which ultimately results in a larger return to the table operator.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A method of playing a wagering game on a electronic gaming machine that comprises: providing an electronic gaming machine, providing a non-transitory computer readable medium encoded with instructions and executed by a processor to perform the steps of;

Providing a video display screen, displaying a pair of dice;

providing a video display screen displaying a traditional craps table, having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

a new single segment having at least one wagering opportunity, the new single segment comprising:

an opportunity to place only a single wager on the single new segment that only covers a set of outcomes, the set only having the outcomes of a double two, a double three, a double four, and a double five, that one of the outcomes of the set will be thrown before a seven is thrown during the play of a craps game;

placing a bet on anyone of the plurality of segments;

after placing the bet, rolling the pair of dice;

determining the outcome of the roll of the dice; and paying an amount of winnings to a player placing a winner wager on at least one of the wagering opportunities within the new segment.

2. A method of playing a wagering game on a electronic gaming machine that comprises: , providing an electronic gaming machine, providing a non-transitory computer readable medium encoded with instructions and executed by a processor to perform the steps of;

Providing a video display screen displaying a pair of dice; providing a video display screen displaying a traditional craps table, having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

wherein a new segment having at least one wagering opportunity, the new segment comprising:

an opportunity to wager on a single specific double selected from the set including double twos, double threes, double fours, and double fives will be thrown before a seven is thrown during the play of a craps game;

placing a bet on anyone of the plurality of segments;

after placing the bet, rolling the pair of dice;

determining the outcome of the roll of the dice; and paying an amount of winnings to a player placing a winner wager on at least one of the wagering opportunities within the new segment.

3. A method of playing a wagering game, providing an electronic gaming machine, providing a non-transitory computer readable medium encoded with instructions and executed by a processor to perform the steps of;

Providing a video display screen displaying a pair of dice providing a video display screen displaying a traditional craps table, having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

a new segment having at least one wagering opportunity, the new segment comprising:

an opportunity to wager that double ones will be thrown before a seven is thrown during the play of a craps game;

a new segment having at least one wagering opportunity, the new segment comprising:

and an opportunity to wager that double sixes will be thrown before a seven is thrown during the play of a craps game;

placing a bet on anyone of the plurality of segments;

after placing the bet, rolling the pair of dice;

determining the outcome of the roll of the dice; and paying an amount of winnings to a player placing a winner wager on at least one of the wagering opportunities within the new segment.

4. A method of playing a wagering game, providing an electronic gaming machine, providing a non-transitory computer readable medium encoded with instructions and executed by a processor to perform the steps of;

Providing a video display screen displaying a pair of dice; providing a video display screen displaying a traditional craps table having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

a tracking grid comprising a new segment providing 21 wagering opportunities each identified with one of the 21 possible combinations that can be thrown when a pair of dice is rolled, where the grid has one row containing six segments and a row containing five segments and a row containing four segments, and a row containing three segments and a row containing two segments and a row containing one segment;

placing a bet on anyone of the plurality of segments;

after placing the bet, rolling the pair of dice;

determining the outcome of the roll of the dice;

paying an amount of winnings to a player placing a winner wager on at least one of the wagering opportunities.

5. A method of playing a wagering game, providing an electronic gaming machine, providing a non-transitory computer readable medium encoded with instructions and executed by a processor to perform the steps of;

Providing a video display screen displaying a pair of dice; providing a video display screen displaying a traditional craps table, having a playing surface comprising a plurality of segments defining a plurality of wagering opportunities including:

a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

a new segment having at least one wagering opportunity, the new segment comprising:

an additional segment which provides an opportunity to wager on the number of consecutive passes that will be made during the play of a craps game; starting at one pass and ending at ten passes with the option to continue the wager or to end the wager by requesting be paid after a pass has occurred;

placing a bet on anyone of the plurality of segments;

after placing the bet, rolling the pair of dice;

Determining the outcome of the roll of the dice; and paying an amount of winnings to a player placing a winner wager on at least one of the wagering opportunities within the new segment.

6. A method of playing a wagering game, providing an electronic gaming machine, providing a non-transitory computer readable medium encoded with instructions and executed by a processor to perform the steps of;

Providing a video display screen displaying a pair of dice; providing a video display screen displaying a traditional craps table having a playing surface comprising a plurality of segments defining a plurality of wagering opportunities including:

A method of gaming comprising the steps of a Pass Line segment for securing a wager betting both that one or more rolls of the dice will yield an established first point without rolling a seven, and a prior number is rolled prior to rolling a first point number;

a Don't Pass Bar segment for securing a wager betting that a seven will be rolled before an established first point number is rolled;

a Come segment for receiving a wager betting that the first number rolled after the come bet is placed will be rolled again before a seven is rolled;

a Don't Come Bar segment for receiving a wager betting that a seven will be rolled before the first number rolled after the don't come bet is placed is rolled again;

a plurality of Place Bet segments each identified with one of the numbers 4, 5, 6, 8, 9 or 10 for receiving a wager that the number associated with the segment will be thrown before a seven is thrown;

at least one Field segment for securing a wager betting that a number selected from the group consisting of the numbers 2, 3, 4, 9, 10, 11 and 12 will be thrown on the next roll;

a Hard Ways segment for receiving a wager betting that a pair of twos, a pair of threes, a pair of fours, or a pair of fives will be thrown before a seven is thrown and before the selected number is thrown in a non-pair combinations;

a Big Six segment for receiving a wager betting that the next roll will yield a six; and a Big Eight segment for receiving a wager betting that the next roll will yield an eight;

a new segment having two single wagering opportunities, the new segment comprising:

an opportunity to wager that a three will be thrown before a seven is rolled during the play of a craps game; and an opportunity to wager that a eleven will be thrown before a seven is rolled during the play of a craps game;

placing a bet on anyone of the plurality of segments;

after placing the bet, rolling the pair of dice;

determining the outcome of the roll of the dice; and paying an amount of winnings to a player placing a winner wager on at least one of the wagering opportunities within the new segment.

* * * * *